US007931226B2

(12) United States Patent
Benvenuti et al.

(10) Patent No.: US 7,931,226 B2
(45) Date of Patent: Apr. 26, 2011

(54) METHOD AND MACHINE FOR FORMING LOGS OF WEB MATERIAL, WITH A MECHANICAL DEVICE FOR FORMING THE INITIAL TURN OF THE LOGS

(75) Inventors: Angelo Benvenuti, Lucca (IT); Romano Maddaleni, Pisa (IT); Luca Cecchettini, Lucca (IT); Andrea Fornai, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 1 day.

(21) Appl. No.: 12/308,126

(22) PCT Filed: Jun. 4, 2007

(86) PCT No.: PCT/IT2007/000389

§ 371 (c)(1),
(2), (4) Date: Jan. 14, 2009

(87) PCT Pub. No.: WO2007/141818

PCT Pub. Date: Dec. 13, 2007

(65) Prior Publication Data

US 2009/0272835 A1 Nov. 5, 2009

(30) Foreign Application Priority Data

Jun. 9, 2006 (IT) ..... FI2006A0141
Mar. 22, 2007 (IT) ..... FI2007A0070

(51) Int. Cl.
*B65H 19/22* (2006.01)

(52) U.S. Cl. ..... 242/533.1; 242/533.2; 242/533.3; 242/521; 242/533

(58) Field of Classification Search .... 242/532.1–532.3, 242/533, 542, 521
See application file for complete search history.

(56) References Cited

U.S. PATENT DOCUMENTS

| | | | | |
|---|---|---|---|---|
| 4,327,877 | A | 5/1982 | Perini | |
| 4,487,377 | A | 12/1984 | Perini | |
| 5,368,252 | A | 11/1994 | Biagiotti | |
| 5,653,401 | A * | 8/1997 | Biagiotti | 242/532.3 |
| 5,979,818 | A | 11/1999 | Perini et al. | |
| 6,050,519 | A * | 4/2000 | Biagiotti | 242/526.1 |
| 6,595,458 | B1 | 7/2003 | Biagiotti | |
| 6,752,345 | B2 | 6/2004 | Betti et al. | |
| 7,523,884 | B2 * | 4/2009 | Gelli et al. | 242/521 |

FOREIGN PATENT DOCUMENTS

| | | | |
|---|---|---|---|
| DE | 198 07 420 | A1 | 9/1999 |
| EP | 0 093 301 | B1 | 4/1983 |
| EP | 0 524 158 | B1 | 3/1994 |
| EP | 0 738 231 | B1 | 1/1998 |
| EP | 0 827 483 | B1 | 7/2000 |
| EP | 1 232 980 | A1 | 8/2002 |
| EP | 1 262 434 | A2 | 12/2002 |
| EP | 1 262 434 | A3 | 4/2004 |
| GB | 1 435 525 | | 5/1976 |
| WO | WO 2004/046006 | A2 | 6/2004 |
| WO | WO 2004/050520 | A2 | 6/2004 |
| WO | WO 2005/075328 | A1 | 8/2005 |

* cited by examiner

*Primary Examiner* — Sang Kim
(74) *Attorney, Agent, or Firm* — Breiner & Breiner, L.L.C.

(57) ABSTRACT

The rewinding machine includes a winding unit; a feed path of a web material; a separator device to sever the web material upon completion of winding each log; an insertion path of the winding cores towards the winding unit; a movable mechanical member to facilitate forming a first turn of web material around each winding core inserted in the insertion path.

44 Claims, 19 Drawing Sheets

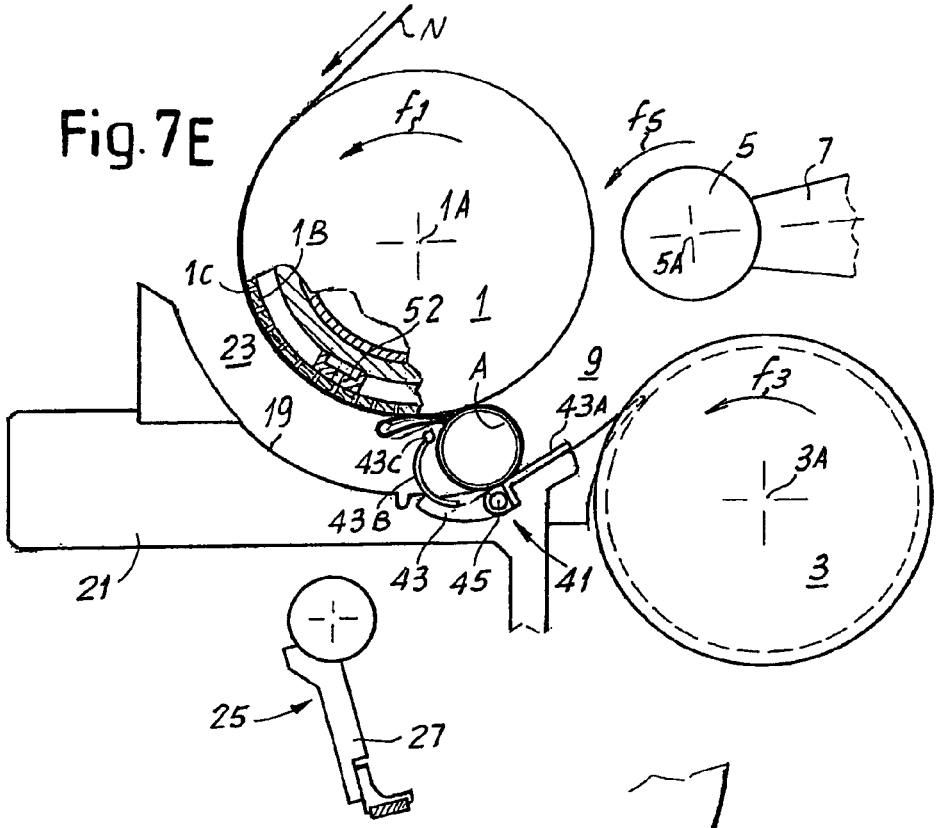
Fig. 7E
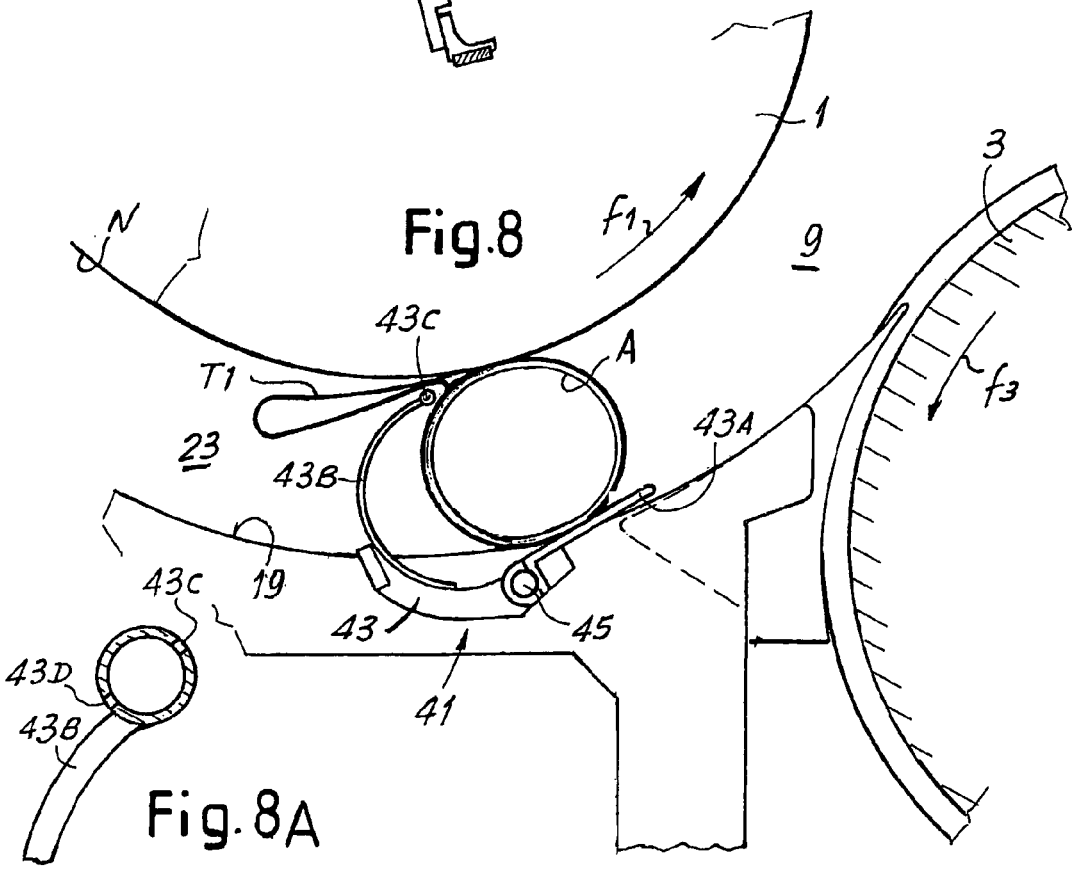
Fig. 8
Fig. 8A

METHOD AND MACHINE FOR FORMING LOGS OF WEB MATERIAL, WITH A MECHANICAL DEVICE FOR FORMING THE INITIAL TURN OF THE LOGS

TECHNICAL FIELD

The present invention relates to methods and machines for producing logs of web material. More specifically, although not exclusively, the present invention relates to methods and machines for producing tissue paper, for example rolls of toilet paper, kitchen towels or the like.

STATE OF THE ART

To produce rolls of web material, for example kitchen towels, toilet paper or the like, rewinding machines are used. These machines are fed with a web material, formed by one or more plies of tissue paper or the like, unwound from a reel of large diameter. Predefined quantities of web material are wound on winding cores to form logs, the axial length of which is equal to the width of the web material fed to the rewinding machine and many times greater than the axial length of the small finished rolls intended for use. These logs are subsequently cut into individual rolls of the desired dimension, which are subsequently packaged.

Modern rewinding machines work continuously, i.e. with feed of the web material at substantially constant speed. Substantially constant is intended as a speed that does not require to be substantially modified upon completion of winding a log and before starting to wind the subsequent log, i.e. during the exchange step.

The exchange step performed upon completion of winding each log is a step in which the web material is severed (preferably along a transverse perforation line) to form a final edge that finishes winding around the completed log, and an initial edge that must be transferred to a new winding core to give rise to forming a subsequent log.

To transfer the initial edge of the web material to the new core and make it adhere thereto, so as to start forming the turns of the new log, there are used, for example, suction systems, with generation of a vacuum pressure inside the tubular core, the cylindrical surface of which is provided with suction holes by means of which the web material is attracted and made to adhere to the outer cylindrical surface of the core. Rewinding machines using this method are described in U.S. Pat. No. 6,595,458.

More commonly, fastening of the initial edge to the new winding core takes place by gluing, applying a glue to the initial free edge of the material or, more frequently, to the new winding core. Examples of rewinding machines using this system are described in EP-A-524158; EP-A-827483; U.S. Pat. Nos. 4,487,377; 5,368,252; 5,979,818; WO-A-2004046006; WO-A-2004050520; EP-A-738231.

Other rewinding machines provide for the use of electrostatic charges to attract the initial free edge of the web material to the winding core and cause the first turn of the new log to form. Examples of rewinding machines using this system are describe in WO-A-2005/075328.

In some cases the start of winding of the initial free edge of the web material produced by tearing, cutting or severing of the web material is facilitated by the use of jets of compressed air. These jets can be used to complete winding of the first turn of web material fastened to the winding core by means of a line of glue. Examples of compressed air nozzles for this function are described in GB-A-1,435,525.

All these known systems require the presence of particularly complex members on the rewinding machine. When glue is used, it is necessary to provide a glue dispenser, which is a costly member and is susceptible to faults. Moreover, the glue represents an expendable material that influences the cost of the finished product and can soil the machine, so that frequent cleaning and maintenance operations are required.

In modern gluing devices for winding cores the glue is applied along a longitudinal line on the cylindrical core and this requires precise angular timing of the core during the step for insertion into the rewinding machine, with consequent costs from the viewpoint of process control.

The use of glue on the winding core also has drawbacks from the viewpoint of the finished product, as the last turn or also more than one turn of the material cannot be used as they adhere to the inner core of the roll. The use of glues also causes problems in the use of removable tubular cores to produce logs without central cores. This is due to the fact that the glue applied between the tubular core and the first turn of the web material makes it more difficult to remove the core, which then requires to be washed before being subsequently reused in the rewinding machine. For this purpose, devices to wash the winding spindles or cores have also been developed, in order to remove residues of glue and of web material from said cores (see U.S. Pat. No. 6,752,345).

The use of electrostatic charges is not used frequently at present due to the difficulty in charging the winding core and/or the web material sufficiently to obtain suitable adhesion between the initial edge of the web material and the winding core. Moreover, adhesion by means of electrostatic charges is currently only possible for limited production speeds.

OBJECTS AND SUMMARY OF THE INVENTION

An object of the present invention is to provide a method of producing logs of web material around tubular winding cores that overcomes entirely or in part the aforesaid drawbacks.

The object of a particular embodiment of the present invention is to provide a method that makes it possible to avoid the use of glue, air jets, electrostatic charges, suction or other costly means to form the first turn of web material on winding cores.

A further object of a particular embodiment of the invention is to provide a method that allows the combined use of a movable mechanical means with a means of another nature, e.g. pneumatic, electrostatic or of other type (e.g. that entails the use of a glue) to form the first turn of web material on the winding core.

In a possible preferred embodiment the invention provides for a method of winding a web material around winding cores, wherein the first turn of web material is formed around the winding core with the aid of a movable mechanical member. In substance, the mechanical member draws towards the winding core so that the initial free edge of the web material is drawn towards or abuts on the cylindrical surface of the winding core to form or complete the first turn of the new log.

According to a possible embodiment of the invention, the method comprises the following steps:

- feeding the web material along a feed path;
- winding a first log of web material;
- upon completion of winding the first log, severing the web material, forming a final edge and an initial edge;
- starting to wind a second log of web material around a new winding core by means of a mechanical member that draws the initial portion (i.e. the portion of web material next to the initial free edge) towards and against the tubular winding core to complete the first turn.

Once the first turn of web material has been formed around the core, the web material is firmly fastened to the winding core and winding of a new log can continue in a reliable manner.

According to a possible embodiment of the invention, the exchange step provides that the new core is carried into contact with the web material along the feed path thereof, before severing of the material, and that the web material is severed upon completion of winding after the core has been carried into contact with the web material and downstream of the contact point with respect to the direction of feed of the core and of the web material.

The winding core can be fed along an insertion path with a translational movement or, preferably, by rolling along a rolling surface. Preferably, the feed speed of the winding core in this step is such that the feed speed of the point of contact of the winding core with the web material is substantially the same as that of the web material. The rolling core is fed along an insertion path and causes, if necessary with the aid of further means and after the web material has been severed, partial winding of a first initial portion of web material around the core. In this case the mechanical member is controlled to complete forming of the first turn of web material around the core drawing towards the core the web material which, due to rolling of the core, is positioned behind said core with respect to the direction of feed.

In an advantageous embodiment the core is fed by rolling along a preferably stationary surface, in contact on one side with the rolling surface and on the other with the web material, which can advantageously be in contact with a guide member, which is fed at more or less the same speed as the feed speed of the web material. After severing of the web material, the initial portion thereof is wedged between the core and the rolling surface, if necessary with the aid of additional means such as air jets, suction means or the like.

The rolling surface defines, together with a guide member of the web material, a channel for insertion of the cores. The mechanical member is disposed and controlled so that, after the core has been fed along the channel rolling over the initial free edge generated by severing of the web material, said mechanical member is inserted into said channel upstream of the core, i.e. behind the core (with respect to the direction of feed of said core in the channel). The mechanical member moves the portion of web material that is positioned behind the core towards the movable guide member forming or completing the first turn of web material by winding the initial portion thereof around the core that is rolling along the rolling surface.

The mechanical member that causes or facilitates forming of the first turn of web material around the new winding core inserted in the rewinding machine can be controlled by an actuator in synchronism with the movement of the core. For example, there can be provided a sensor which detects the passage of the core in a predetermined positioned and which, as a function of this detection, activates the actuator member which moves said mechanical member. The mechanical member avoids or reduces the need to use glues, suction systems, pressurized air jet systems or electrostatic charges, simplifying the structure of the rewinding machine and eliminating material or power consumption sources.

Moreover, to obtain even greater simplification, according to a preferred embodiment of the invention, the mechanical member is a passive member. Passive member is intended as a member whose movement is not caused by an actuator, but for example by interaction with the winding core that is moving along the insertion path. This makes the presence of an actuator, and consequently control thereof in synchronism with the other elements of the machine, superfluous.

In this case, according to a preferred embodiment of the invention, the method provides that the core is fed along a feed path which interferes with the mechanical member, i.e. a path inside which the mechanical member projects at least partly to be touched and moved by the core in the movement thereof. Passage of the core causes a movement, for example an oscillating movement of the mechanical member and insertion of the mechanical member in the insertion path upstream of the winding core to thus draw the web material towards the core and form or complete the first turn of web material.

In a possible embodiment, when the winding core is inserted by means of rolling on a fixed surface, the mechanical member can be hinged about an axis external to the channel and at least approximately parallel to the axis of the core positioned in said channel. Preferably, the mechanical member is made to rotate or oscillate about this axis in synchronism with the passage of the core along the channel, for example, as mentioned above in the case of a passive member, as a result of interaction between the core and the mechanical member. Preferably, the movement will be an oscillating movement, although it would also be possible for the mechanical member intended to form or facilitate forming of the first turn of web material around the new core to perform a complete rotation at each cycle.

According to a different aspect, the invention relates to a rewinding machine for producing logs of web material that simplifies fastening of the web material to each winding core inserted into the machine.

According to a particularly advantageous embodiment of the invention, the machine comprises: a winding unit; a feed path of a web material; a separator device to sever the web material upon completion of winding each log; an insertion path of the winding cores towards the winding unit; a movable mechanical member to facilitate forming a first turn of web material around each winding core inserted in said insertion path.

According to an advantageous embodiment of the invention, the movable mechanical member is a passive member, i.e. it is arranged and designed such that its movement, e.g. a rotating or oscillating movement, is controlled as a result of interaction with the winding core being fed along the insertion path.

For example, according to a possible embodiment, the mechanical member can comprise a projection extending in the insertion path of the cores arranged and designed to interact with the cores being fed along said path. Interaction between the projection of the movable mechanical member and the cores causes activation, i.e. movement of the mechanical member and consequently its effect to overturn the initial edge of web material around the core inserted in the insertion path to complete forming of the first turn and thus guarantee fastening of the web material to the core without or with reduced need for electrostatic charges, suction, glue or other measures.

The mechanical member can, for example, comprise a folding arm, typically and preferably a curved arm, with an intrados facing the core when the latter has moved beyond, along the insertion path thereof, the activation position of the mechanical member. This oscillating or rotating arm draws close to the core from behind with respect to the direction of feed of the core along the insertion path.

According to a possible preferred embodiment of the invention, the machine comprises: a rolling surface for the winding cores; a movable guide member, for example a belt or a roller, arranged and designed so that the feed path of the web material extends at least partly in contact with said movable guide member, and so that it forms, with the rolling surface, a channel for insertion of the cores, in which the winding cores are carried into contact with the rolling surface and with the web material. The mechanical member is in this case disposed and controlled to be inserted in the channel upstream of a respective core traveling along the insertion path that extends at least partly in said channel.

According to further aspect, the invention provides for a method for winding a web material around a winding core, wherein around said winding core there is formed a first turn of web material with the aid of a movable mechanical member and of at least one gaseous flow, in particular an air flow, generated by means of blowing members carried by said movable mechanical member, to favor winding of said first turn around said core.

According to still a further aspect, the invention provides for a method to wind a web material around a winding core, wherein around said winding core there is formed a first turn of web material with the aid of a movable mechanical member, wherein the web material is fed around a winding roller and wherein there is generated a gaseous flow, in particular an air flow to favor detachment of the web material from said roller upon completion of winding a log of web material.

According to another aspect, the invention relates to a rewinding machine for producing logs of web material wound around winding cores comprising: a winding unit; a feed path of a web material; a separator device to sever the web material upon completion of winding each log; an insertion path of the winding cores towards said winding unit; characterized by a movable mechanical member to aid forming a first turn of web material around each winding core inserted in said insertion path and by at least one blowing member carried by said mechanical member, to generate a gaseous flow, in particular an air flow that favors winding of the first turn. In addition to the blowing member carried by the mechanical member, or in alternative thereto, according to a further aspect of the invention there can be provided a device that generates a gaseous flow, in particular an air flow exiting from the cylindrical surface of said winding roller to facilitate detaching of an initial free edge of the web material from the winding roller upon completion of winding a log of web material.

Further characteristics and advantageous embodiments of the method and of the machine according to the invention will be described hereunder with reference to some non-limiting examples of the invention, and will be further defined in the appended claims.

BRIEF DESCRIPTION OF THE DRAWINGS

The invention will be better understood by following the description and accompanying drawing, which shows practical non-limiting embodiments of the invention. More specifically, in the drawing, where the same or equivalent parts are indicated with the same reference numbers:

FIGS. 7A-7E show an operating sequence of the machine in one embodiment;

FIG. 8 shows an enlargement of the mechanical member;

FIG. 8A shows an enlargement of the end part of the mechanical member with the blowing nozzles;

DETAILED DESCRIPTION OF SOME EMBODIMENTS OF THE INVENTION

Figure 1A:
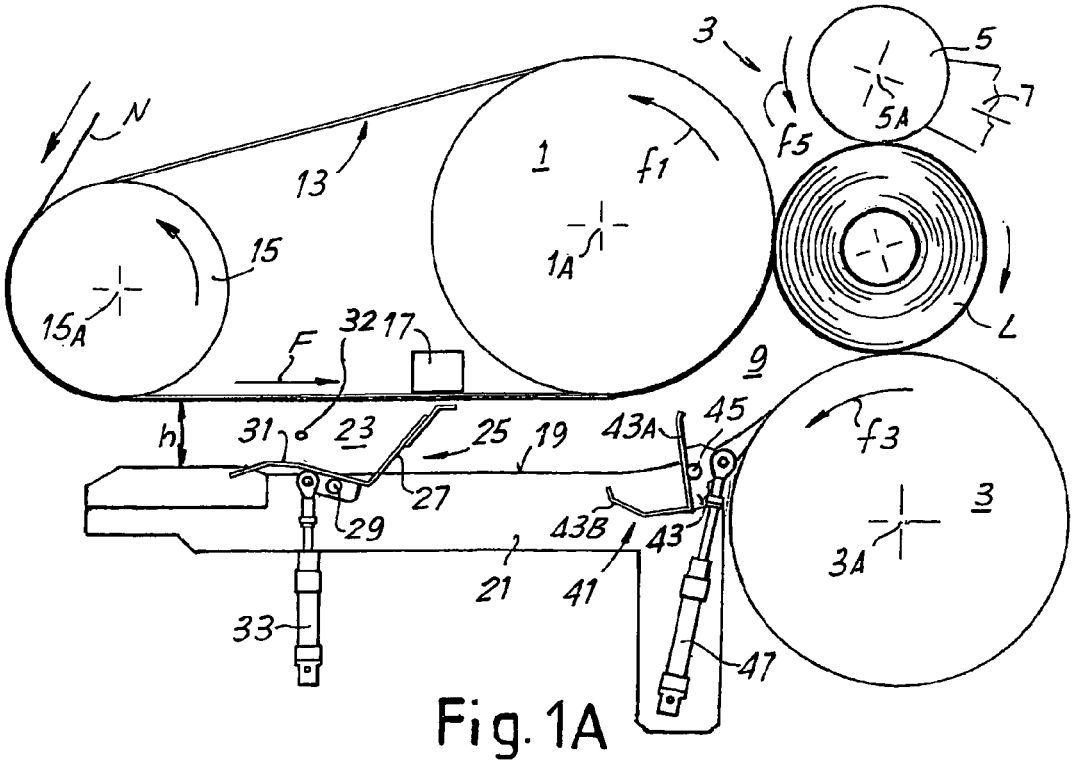
FIGS. 1A to 1F show a first embodiment of the invention in an exchange operating sequence.

The accompanying figures show the members of the rewinding machine in different embodiments of the invention, limited to those parts of the machine that are necessary in order to understand the principle on which the invention is based. Other parts of the machine can be designed in a manner known per se to those skilled in the art and, for example, in particular as described in the publications mentioned in the introductory part of this description, the content of which is fully incorporated herein. More specifically, the operating sequence illustrated in the figures of the drawing show the members of the winding head, i.e. those members used to feed the web material and to insert the cores, as well as to sequentially form the individual logs of web material around the respective tubular cores.

With initial reference to FIGS. 1A to 1F, 3 and 4, the rewinding machine, indicated as a whole with 1, comprises a winding unit 3 including: a first winding roller 1 rotating in the direction of the arrow f1 about an axis of rotation 1A; a second winding roller 3 rotating according to the arrow f3 about an axis of rotation 3A; a third winding roller 5, rotating in the direction of the arrow f5 about an axis 5A. The number 7 indicates an oscillating arm that allows the roller 5 to move so that the log L that is in the winding cradle defined by the rollers 1, 3 and 5 can increase in diameter to the final dimension.

Between the rollers 1 and 3 a nip 9 is formed, through which the web material N passes (for example a cellulose web material, such as a sheet of tissue paper), which is fed through a perforator unit (not shown) that generates a series of transverse perforation lines to divide the web material N into individual sections or sheets which, in the final using step, can be detached individually.

The web material N is fed along a feed path that extends partly around a winding roller 1 as well as adhering to a movable guide member 13 formed, in this embodiment, by a belt or by a series of belts parallel to one another suitably supported by sliding surfaces or shoes. The belts forming the guide member 13 of the web material N are fed around the winding roller 1, preferably housed in respective annular grooves, and around a roller 15 rotating about an axis 15A approximately parallel to the axis 1A of the roller 1 with a peripheral speed approximately the same as the peripheral speed of the winding roller 1 and as the feed speed of the web material N. This speed preferably remains approximately unchanged during the winding cycle and in particular during the exchange step.

Between the rollers 1 and 15, inside the path defined by the belts forming the guide member 13, there is disposed a fixed counter element 17 which can have sliding and guide grooves for the belts forming the guide member 13.

Figure 3:
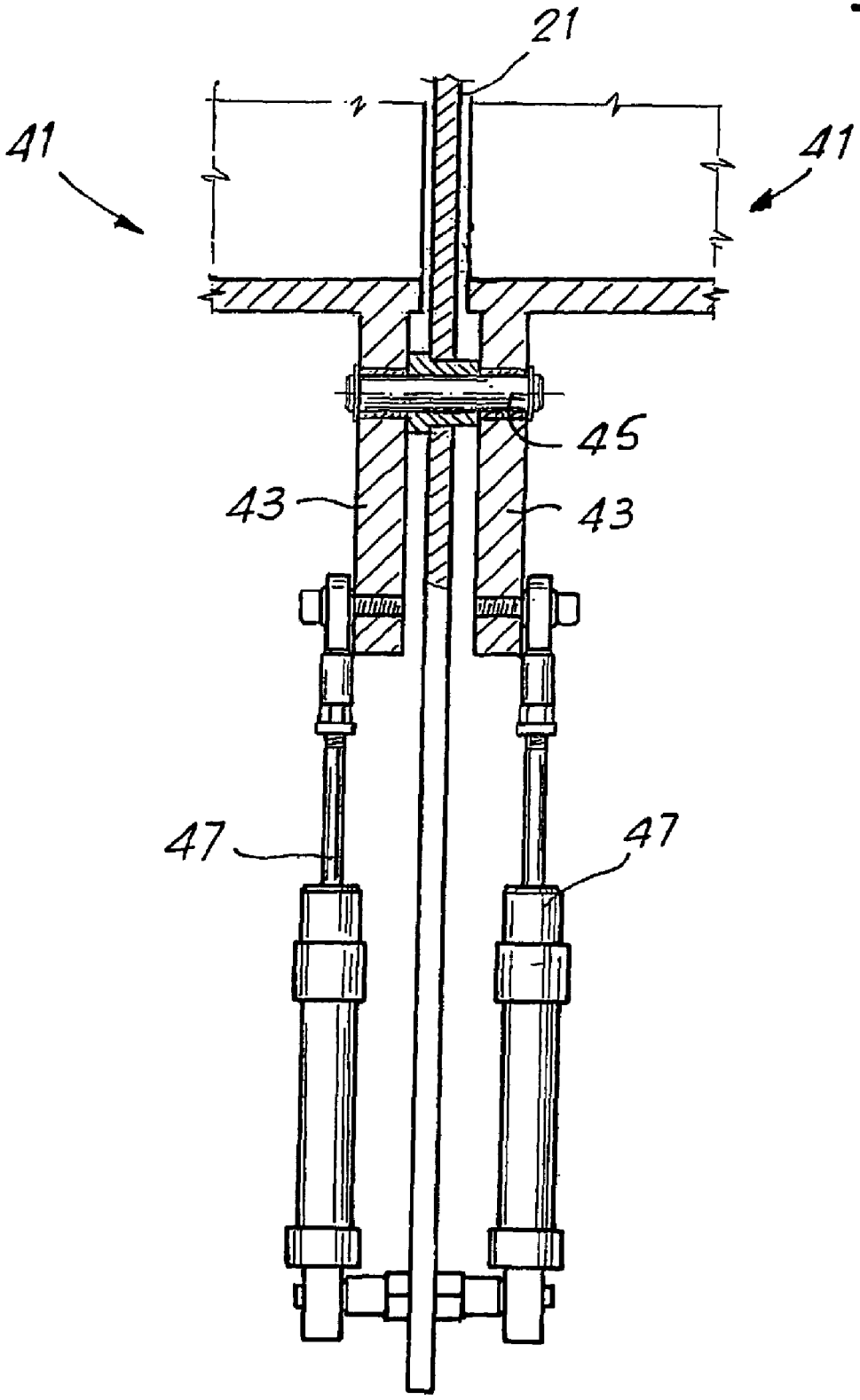
FIG. 3 shows a section indicatively according to the line III-III in FIG. 2B.
Figure 4:
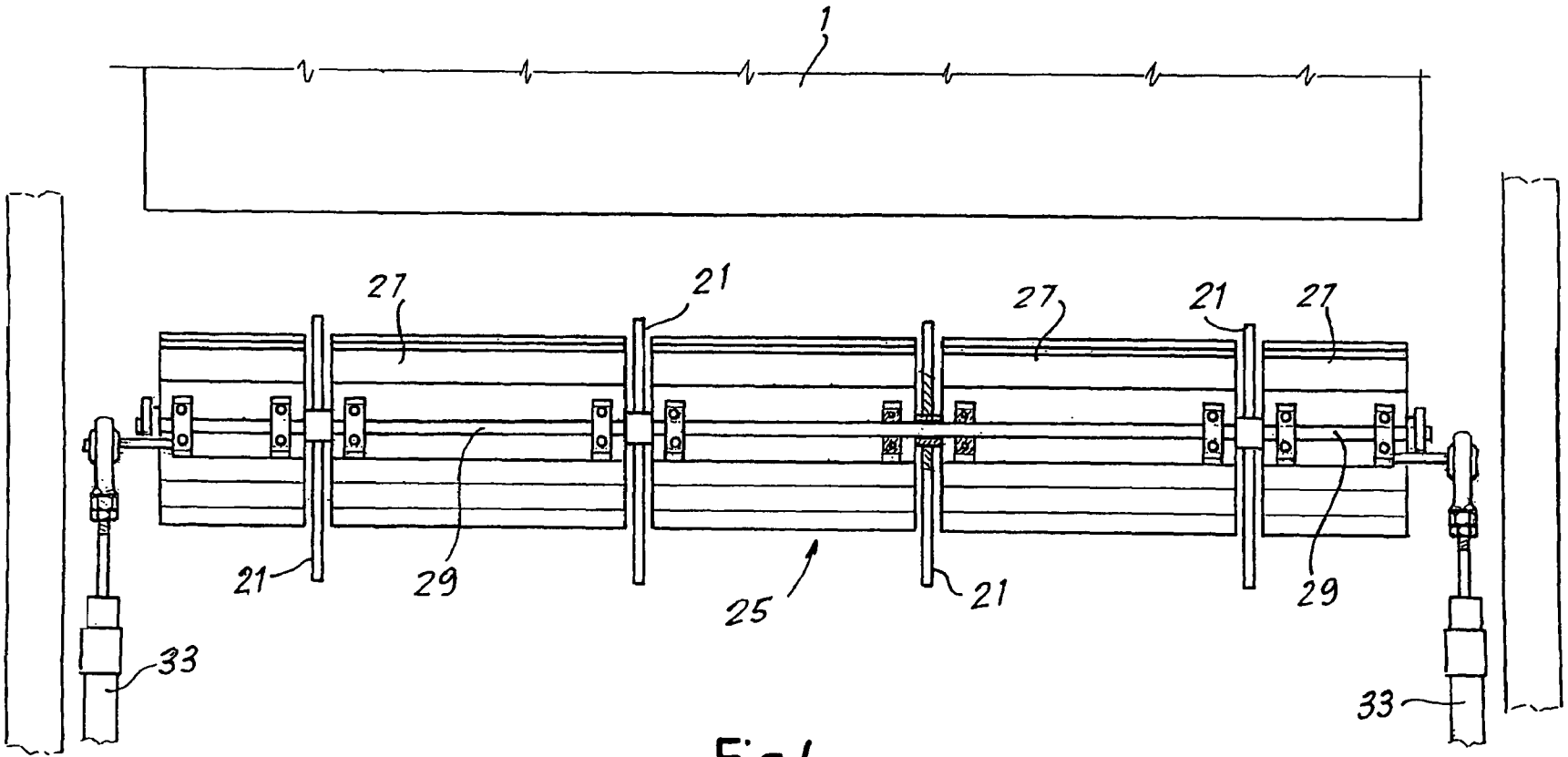
FIG. 4 shows a section indicatively according to IV-IV in FIG. 2A.
Figure 5A:
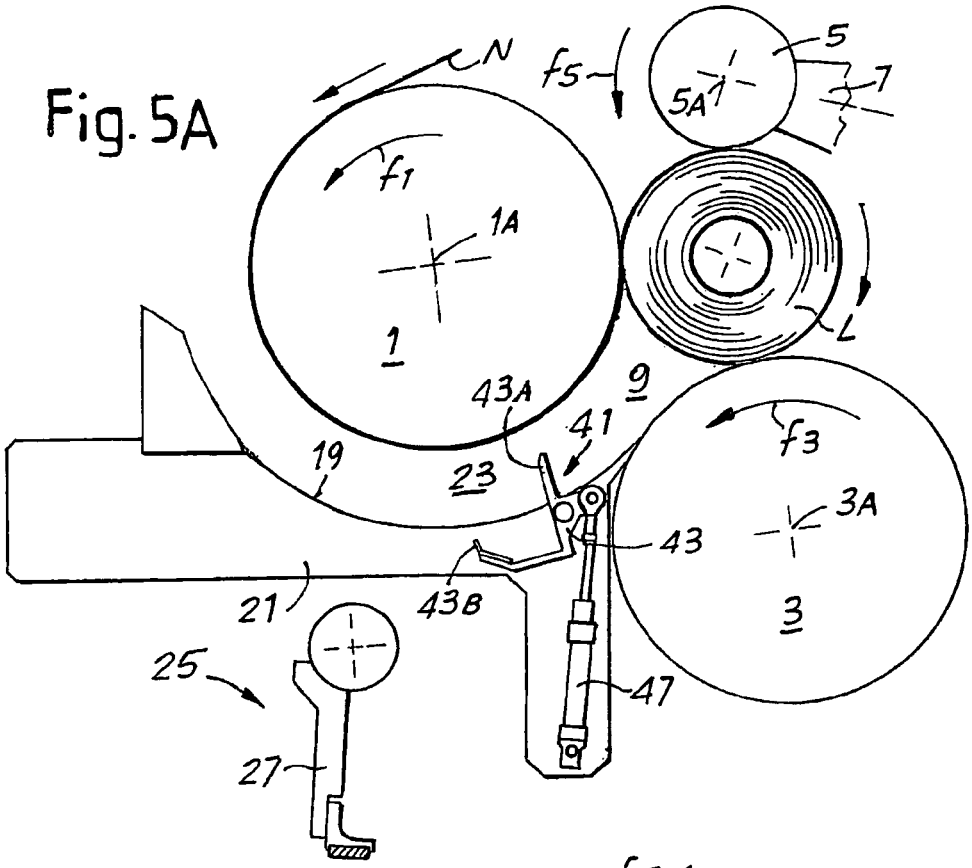
FIGS. 5A to 5E show an operating sequence of a further embodiment of the invention.
Figure 5B:
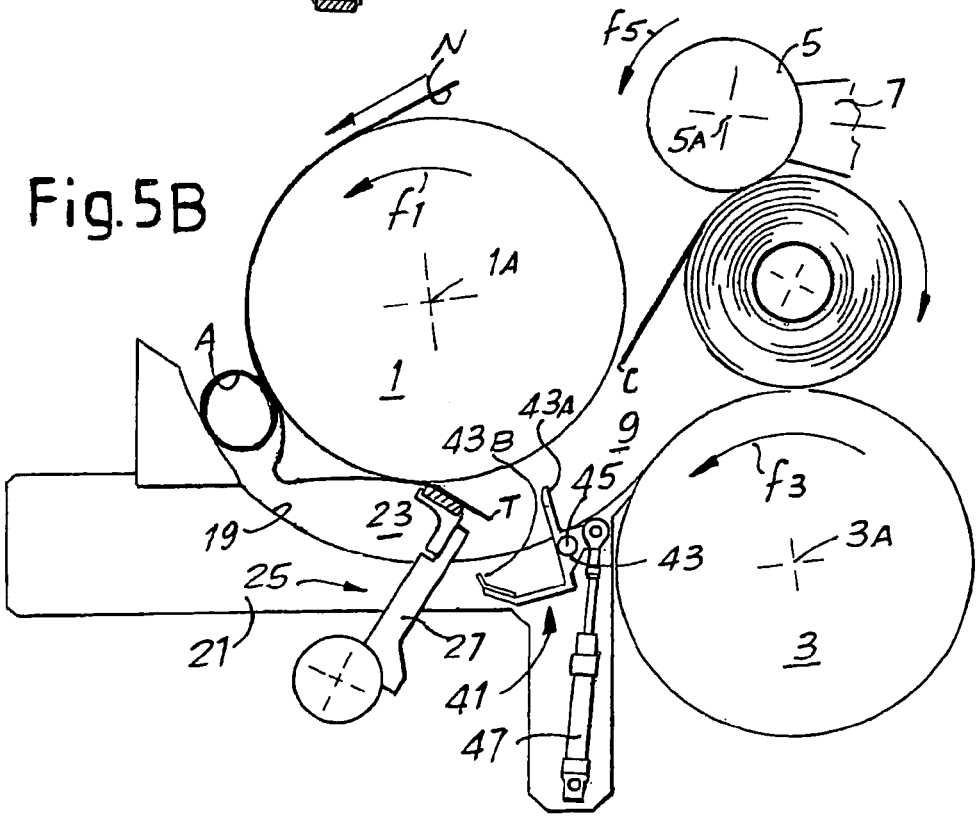
Figure 5C:
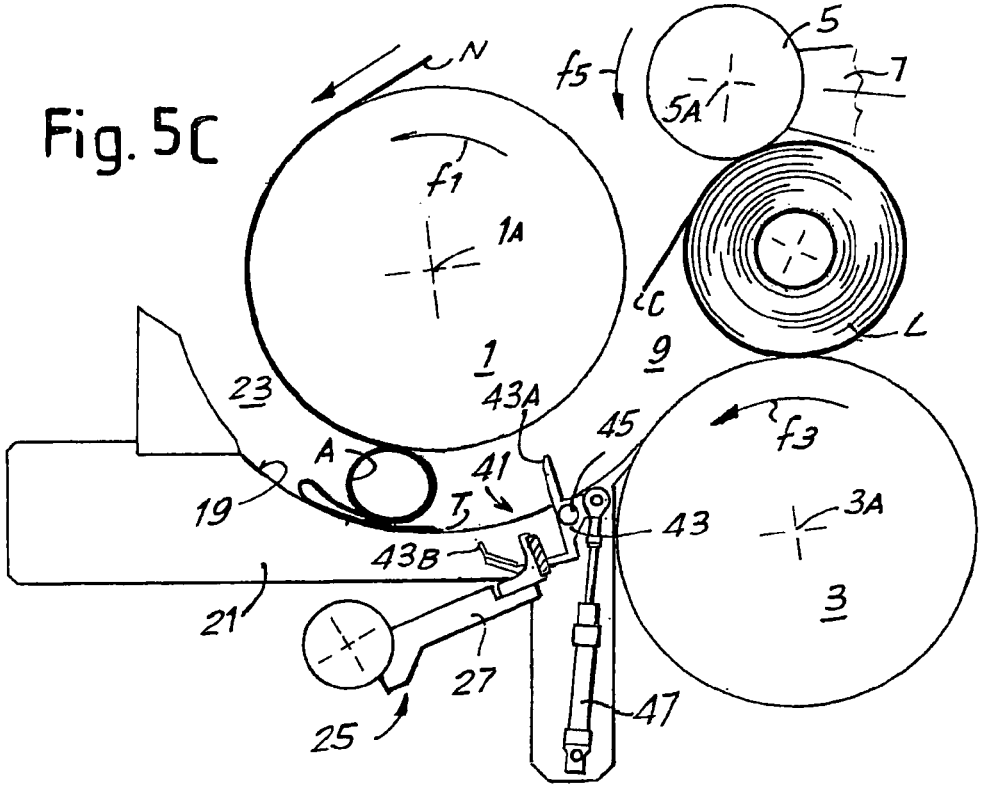
Figure 5D:
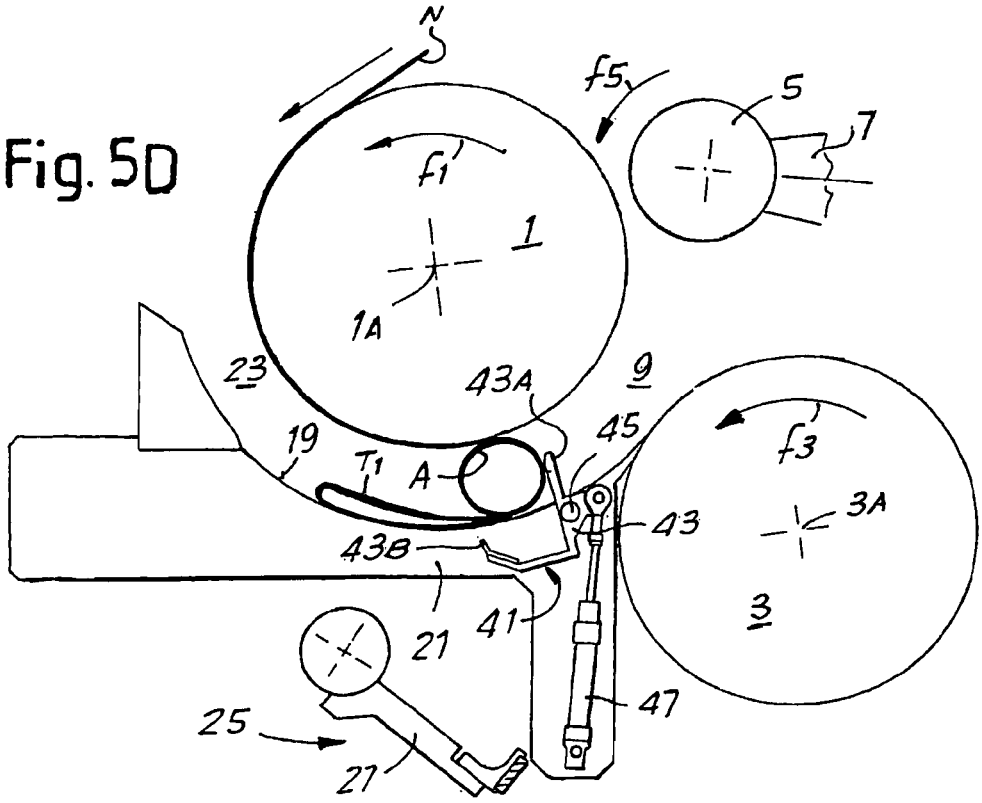
Figure 5E:
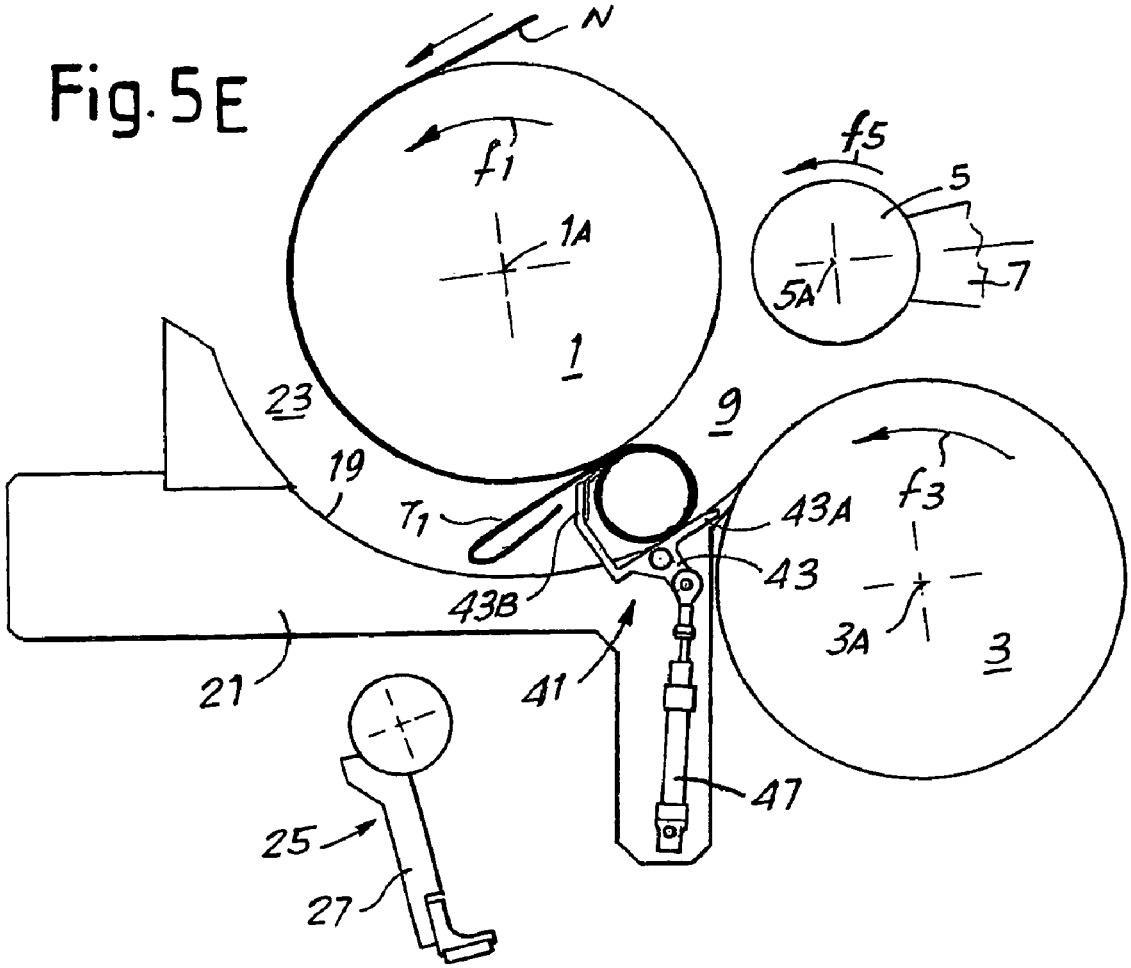

In front of the lower branch of the guide member 13 there extends a rolling surface 19 formed by a series of sections 21 parallel to one another and relatively thin, as shown by way of example in FIGS. 3 and 4. In these figures there are visible sections 21 forming the rolling surface 19. The individual sections 21 extend inside annular grooves in the roller 3 to form therewith a substantially continuous rolling surface of the winding core inserted in the machine each time. The rolling surface 19 defines, with the lower branch of the movable guide member 13, a channel 23 for insertion of the cores, said channel having in the entry area a slightly lower height h than the height of the remaining part of the channel, so as to cause elastic deformation of the winding core inserted each time by means of insertion members, not shown. In fact, the height h is lower than the external diameter of the winding core. The remaining part of the channel 23 is also slightly lower with respect to this external diameter to maintain the various winding cores firmly in contact with the rolling surface 19 and with the web material N fed along the feed path in contact with the belts forming the guide member 13.

In an intermediate position along the extension of the channel 23 a separator device 25 is arranged, which is used to sever the web material N upon completion of winding each log. The separator device is shown in a schematic front view in FIG. 4. It is formed by a plurality of pressers 27 hinged about a common axis 29 which extends transversely, approximately at 90°, with respect to the direction of feed of the web material N along the lower branch of the guide member 13. The pressers 27 preferably have an elastic structure and form part of substantially L-shaped brackets, extending on the opposite side with respect to the axis of oscillation 29 in shaped projections 31 that project inside the channel 23 upstream of the axis of oscillation 29 with respect to the direction of feed of the web material N (arrow F) and of the cores along the channel 23. Reference number 33 indicates a piston-cylinder actuator, which can also be replaced by a different member for moving and angularly controlling the separator device 25 in synchronism with the movement of the core, which normally maintains the separator device 25 in the arrangement shown in FIG. 1A. For example, an electronically controlled electric motor can be used, preferably aligned with the axis of oscillation of the separator device 25. Activation of the actuator 33 (whether this is a piston cylinder actuator, an electric motor or another device) can be caused by passage of the core, for example by means of a sensor that detects passage of the core in a specific position. FIG. 1A schematically indicates with 32 a sensor having this function. This can be an optical sensor, a photocell, a microswitch or the like. The sensor 32 can be used to control oscillation of the device counter-clockwise (in the drawing), in order to obtain severing of the web material and/or clockwise (again with reference to the drawing) to allow travel of the core after cutting or severing of the web material. In this way the need to use the core directly as actuating member of the oscillating movements of the device 25 is reduced or eliminated. In any case, however, control of severing of the web material is obtained as a consequence of travel of the core in a specific point or area of the insertion path thereof, without the need to synchronize the severing device with other mechanical members of the machine, as occurs in more complex rewinding machines.

In a preferred embodiment, a simple elastic member can be used (such as a pneumatic spring constituted by a piston-cylinder system 33), which constrains the separator device 25 in an idle position, the activation movement being controlled entirely by passage of the core. A shock absorber can be combined with the elastic member to dampen the return movement of the separator device 25, after the core A has moved beyond this device (passage from FIG. 1D to FIG. 1E).

Figure 2A:
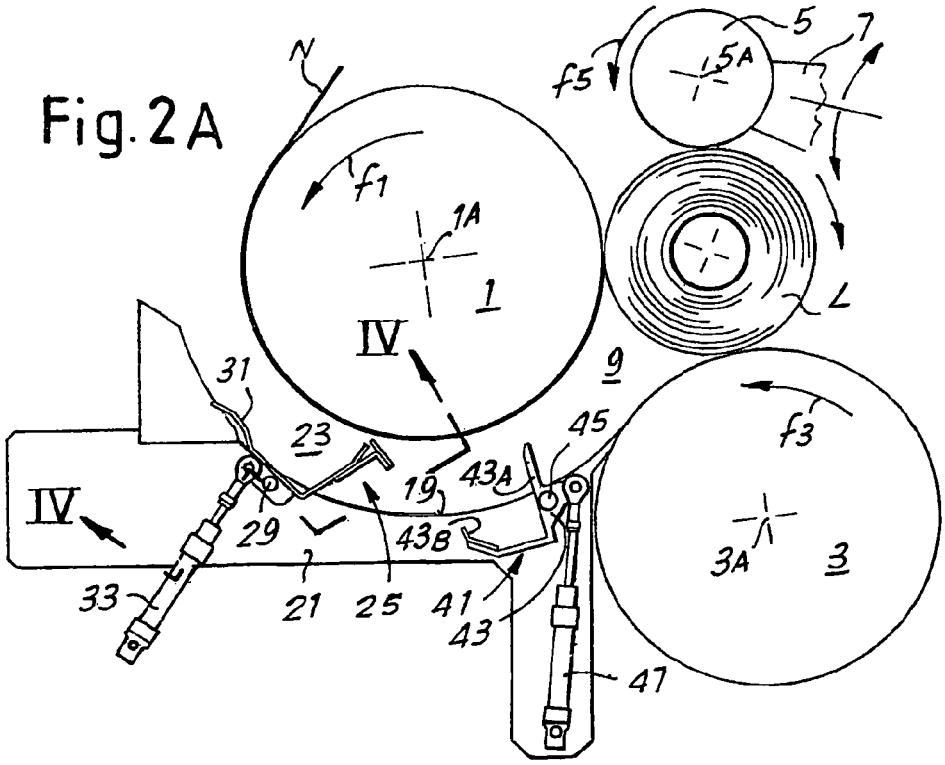
FIGS. 2A to 2F show an operating sequence of a second embodiment of the invention.
Figure 2B:
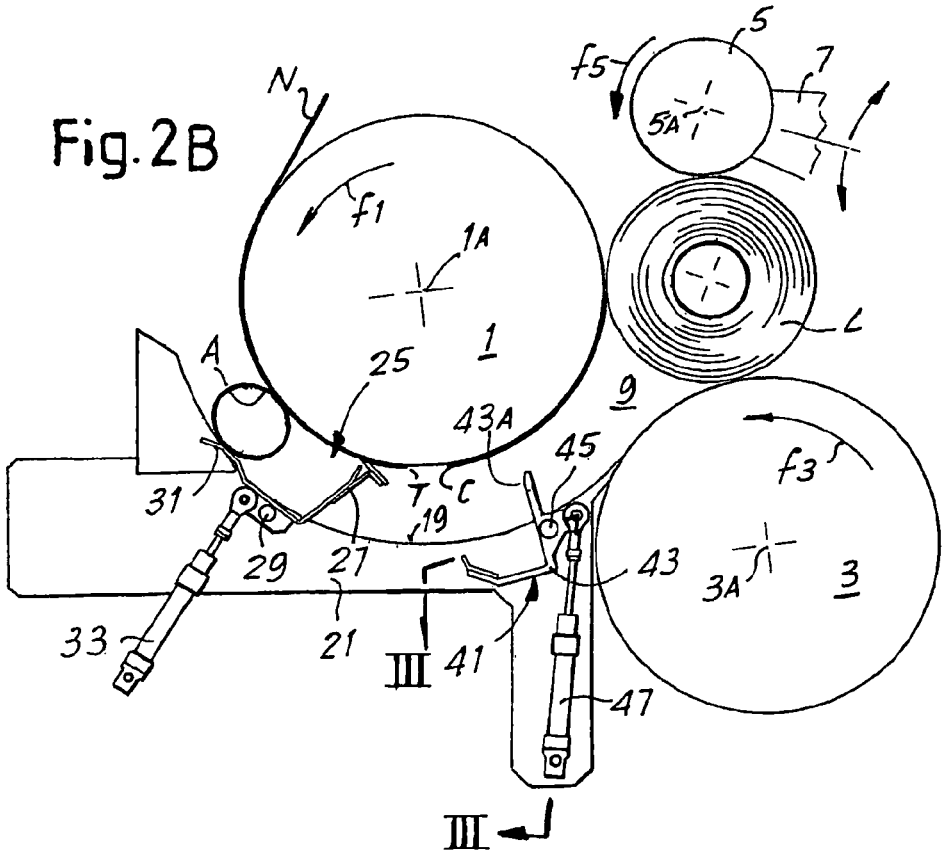
Figure 2C:
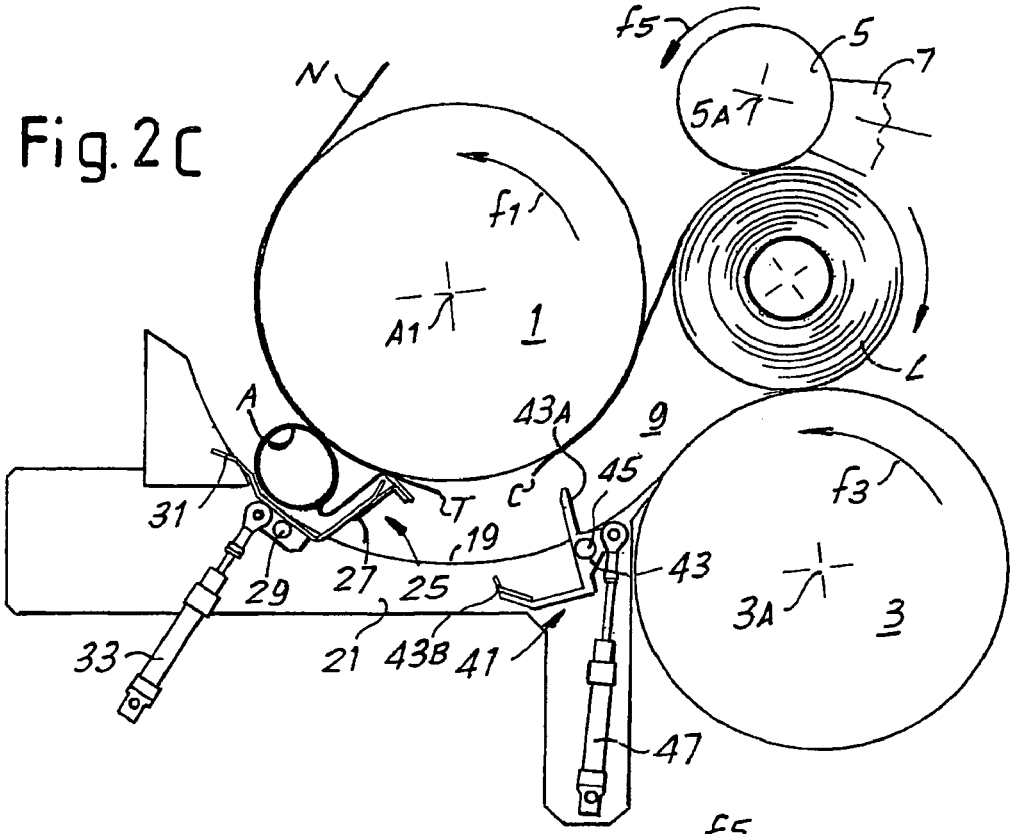
Figure 2D:
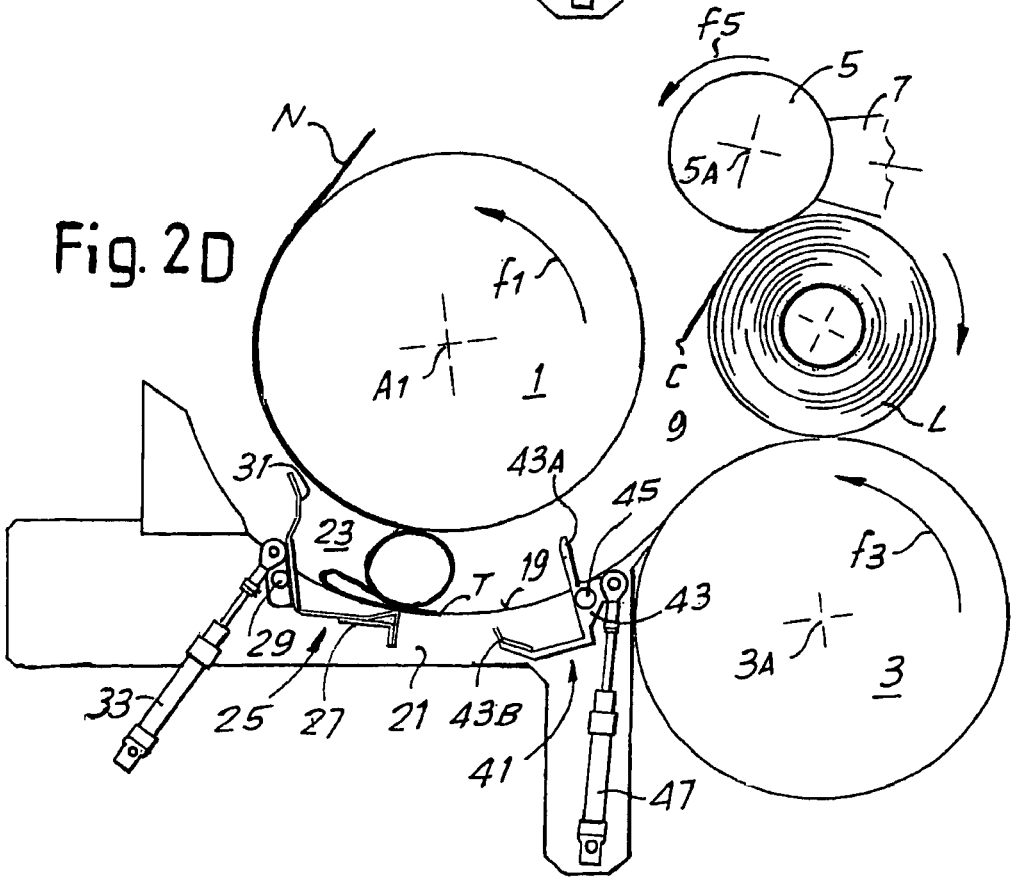
Figure 2E:
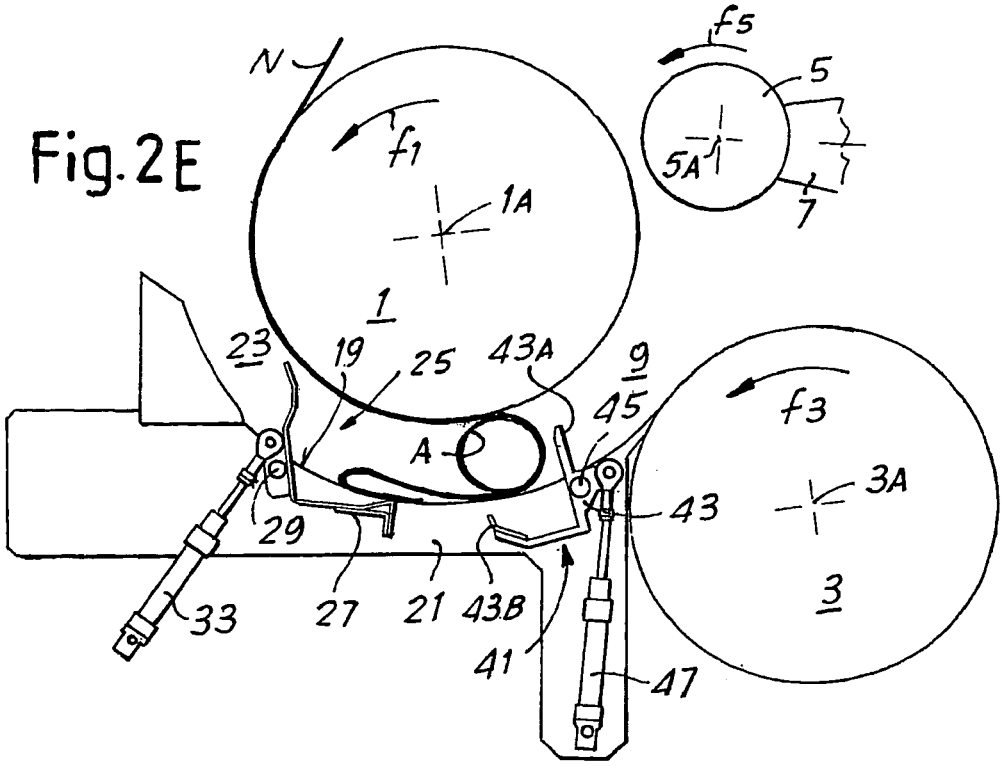
Figure 2F:
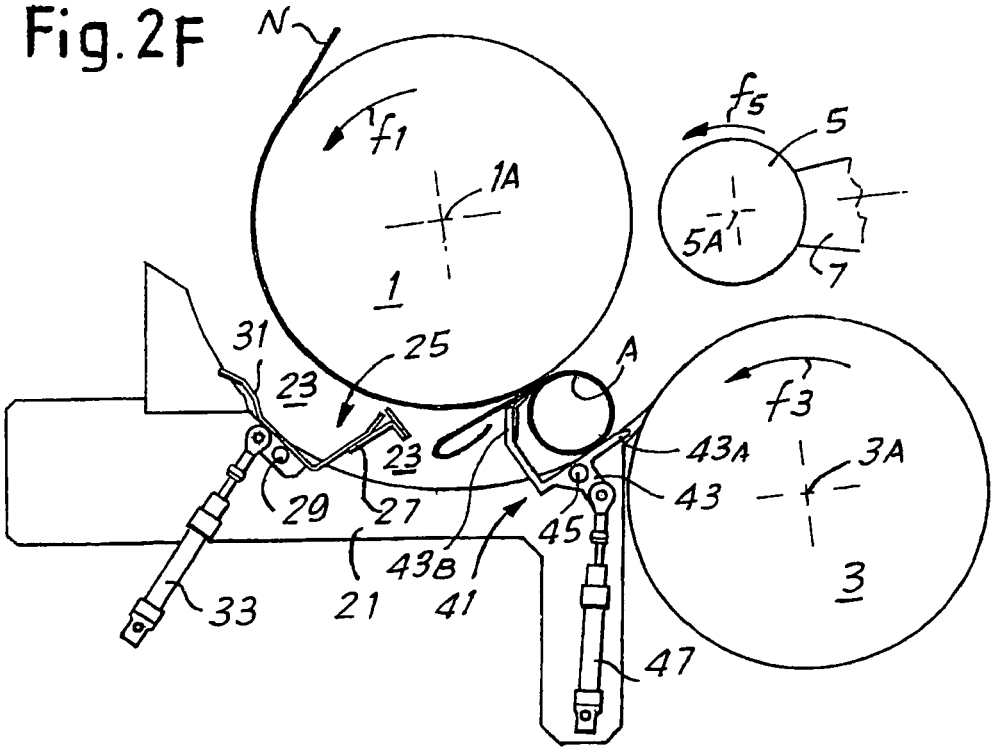

In the idle position in FIG. 1A the upper ends of the pressers 27 (if necessary coated with a yielding material and/or with a high coefficient of friction) are at a certain distance, e.g. a few millimeters or a few centimeters, from the web material N which is fed in contact with the guide member 13 in a position opposite the counter element 17. Above the upper ends of the pressers 27 there can also be mounted rigid or semi-rigid plates to facilitate braking of the web material against the counter element 17 (FIG. 2A). Moreover, it would also be possible for the counter element 17 to have a cutting groove or counter blade; in this case the upper ends of the pressers 27, preferably with toothed profile, penetrate the groove and break the web material. This tearing system is particularly advantageous in the case of web material without transverse perforation lines, usually used for tearing upon completion of winding.

Downstream of the separator device 25 there is disposed a movable mechanical member 41 intended to form or facilitate forming of the first turn of web material around each winding core that is fed towards the winding area along the channel 23. This movable mechanical member 41 has the shape shown in FIG. 3 limited to a portion of the member. In substance, the member 41 is formed of a plurality of brackets 43 hinged around an axis 45 oriented at approximately 90° with respect to the direction of feed of the web material N and therefore approximately parallel to the oscillation axis 29 of the separator device 25 and to the axes 15A, 1A, 3A and 5A of the rollers 15, 1, 3 and 5.

Each bracket 43 has a projection 43A which, in non-operating or idle conditions, projects as shown in FIG. 1A inside the channel 23. Besides the projection 43A, each bracket 43 has a curved arm 43B which, in the example shown, is formed by three rectilinear lengths at an angle from one another, but which could also take a curved shape or be formed by a smaller number of rectilinear lengths at an angle from one another, or also by a sequence of rectilinear and curvilinear lengths.

Preferably each bracket 43 is associated with a member that maintains said bracket in an idle position shown in FIG. 1A. In the example shown in FIGS. 1A-1F, 4 said member is constituted by a piston-cylinder actuator 47, although it would also be possible to use different members, such as a mechanical spring, a member for movement and angular control of the movable member 41 in synchronism with the movement of the core or even simply a counterweight. The counterweight can be constituted by a suitably dimensioned portion of said movable member 41, for example the portion 43B.

The machine described above operates in the manner illustrated hereunder with reference to the sequence in FIGS. 1A to 1F. FIG. 1A shows a conclusive step of winding a log L in the winding cradle formed by the three winding rollers 1, 3 and 5. A new winding core has not yet been inserted in the channel 23.

Figure 1B:
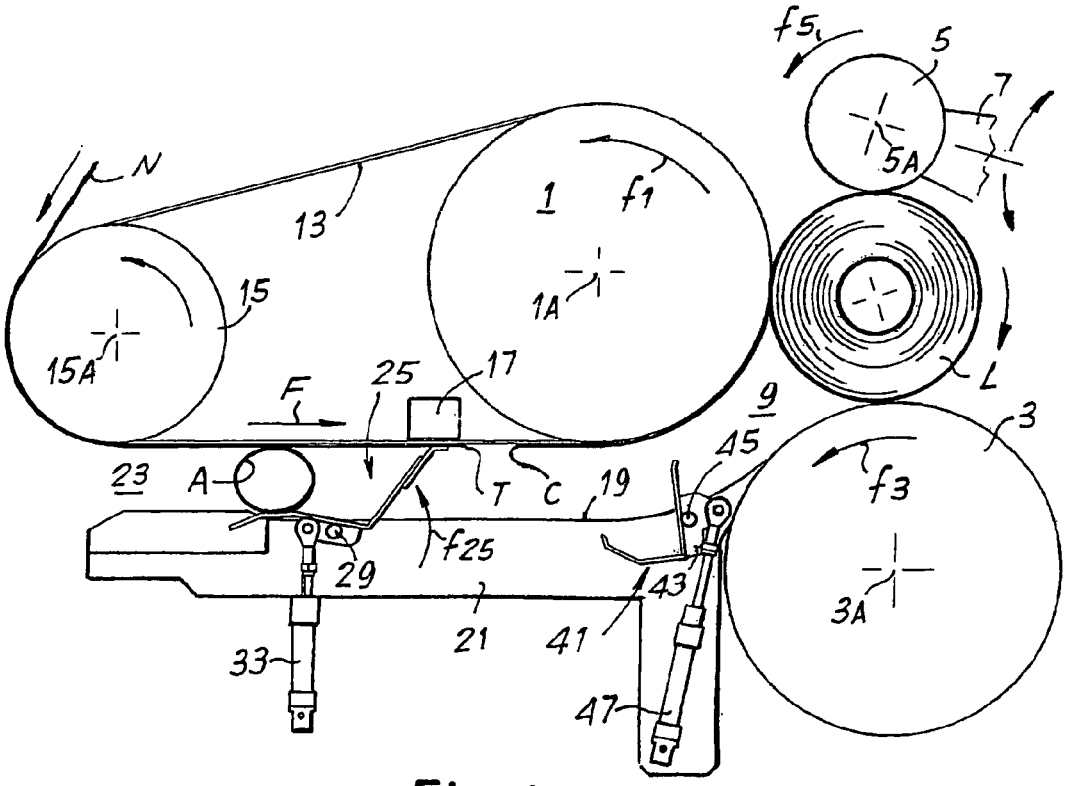

FIG. 1B shows the subsequent step, in which the subsequent winding core A has been inserted into the channel 23 by means of an inserting member of a type known per se and not shown. The winding core A, for example made of cardboard, plastic or another yielding material, is forcedly introduced into the channel 23 of a lesser height than the external diameter thereof so that it comes into contact under pressure with the rolling surface 19 and with the web material N fed around the roller 15 and in contact with the guide member 13. Consequently, the core A accelerates angularly taking in the point of contact with the web material N a speed substantially the same as the feed speed of the web material N, with possible negligible slipping.

The core A rolls along the rolling surface 19 following an insertion path that extends inside the channel 23. During this movement the core A encounters (FIG. 1B) the projections 31 of the brackets forming the separator device 25. As these projections 31 project inside the channel 23, travel of the core A causes a downward thrust of the projections 31 that are located (with respect to the direction of feed of the core) upstream of the point of oscillation 29. This causes oscillation in a counter-clockwise direction (in the figure) according to the arrow f25 of the separator device 25. The upper ends of the pressers 27 of the separator device 25 thus press against the web material N pinching it between the bent upper ends of the pressers 27 and the counter member 17 (if necessary coated with a yielding material and/or with high friction) located on the opposite side of the web material N. Advantageously, the pressers 27 can act between parallel and spaced belts forming the guide member 13 so that the web material N is pinched between the upper bent projections of the pressers 27 and the counter member 17, which is preferably fixed. The counter-clockwise oscillating movement 25 thus causes the web material N to stop or even a slight movement in the opposite direction with respect to the direction of feed. As a consequence of this, the web material is torn along one of the perforation lines generated by a perforator, not shown, thus forming a final free edge C which will complete winding on the log L and an initial free edge T that must start to be wound around a new winding core A (FIG. 1B).

Figure 1C:
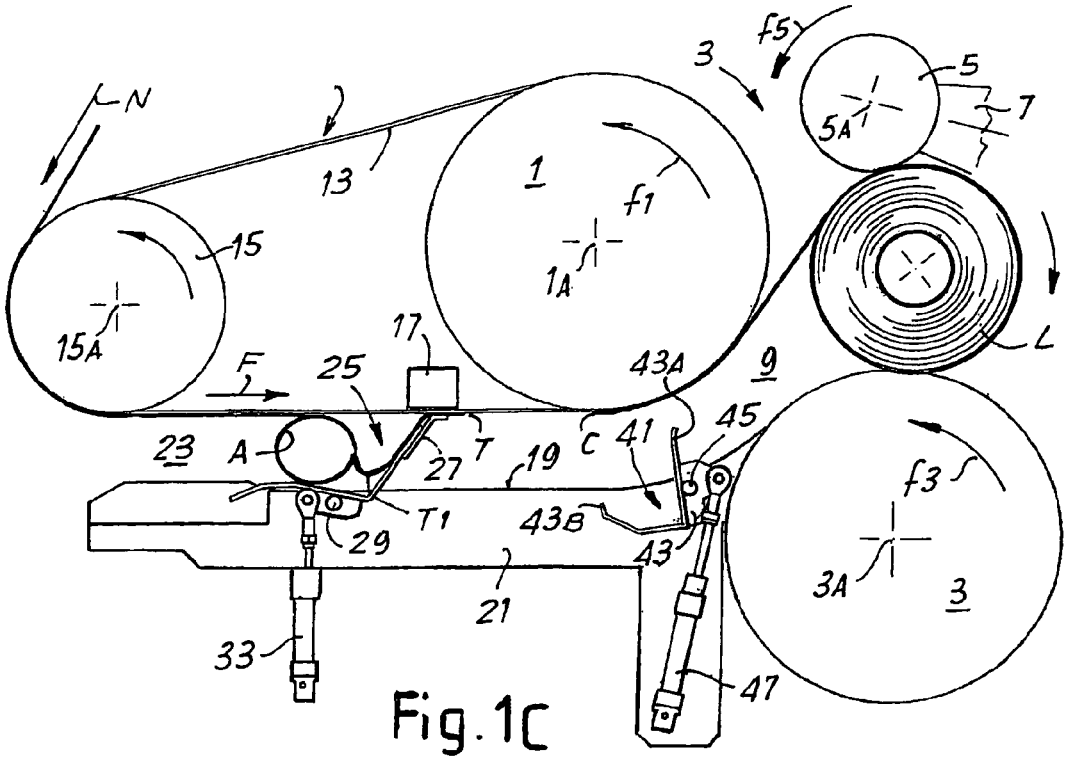

FIG. 1C shows a subsequent step, in which the winding core A is rolling along the channel 23 towards the pressers 27 and an initial portion T1, adjacent to the initial free end T, of the web material N is forming a loop between the new winding core A and the pressers 27 of the separator device 25. To facilitate winding of the first turn of web material around the winding core T1 there can be used means known to those skilled in the art, such as jets of air or suction, electrostatic or other means.

Continuing to travel by rolling along the channel 23, the winding core A comes into contact with the pressers 27 and, as a result of the rolling imparted by the guide member 13 (which also constitutes the feed member of the winding cores along the insertion path), exerts a thrust on the pressers 27. Consequently, these are withdrawn under the rolling surface 19 overcoming the force of the return member 33. This allows the core A to travel beyond the separator device 25 rolling over the loop of web material T1 FIG. 1D).

Figure 1D:
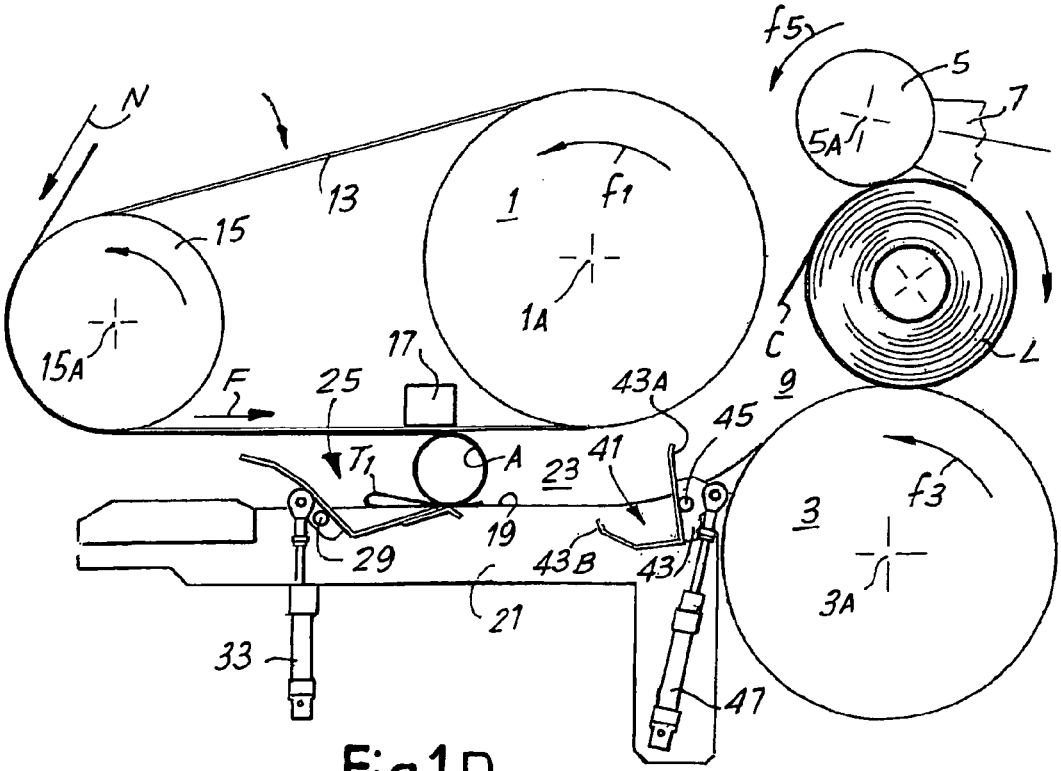
Figure 1E:
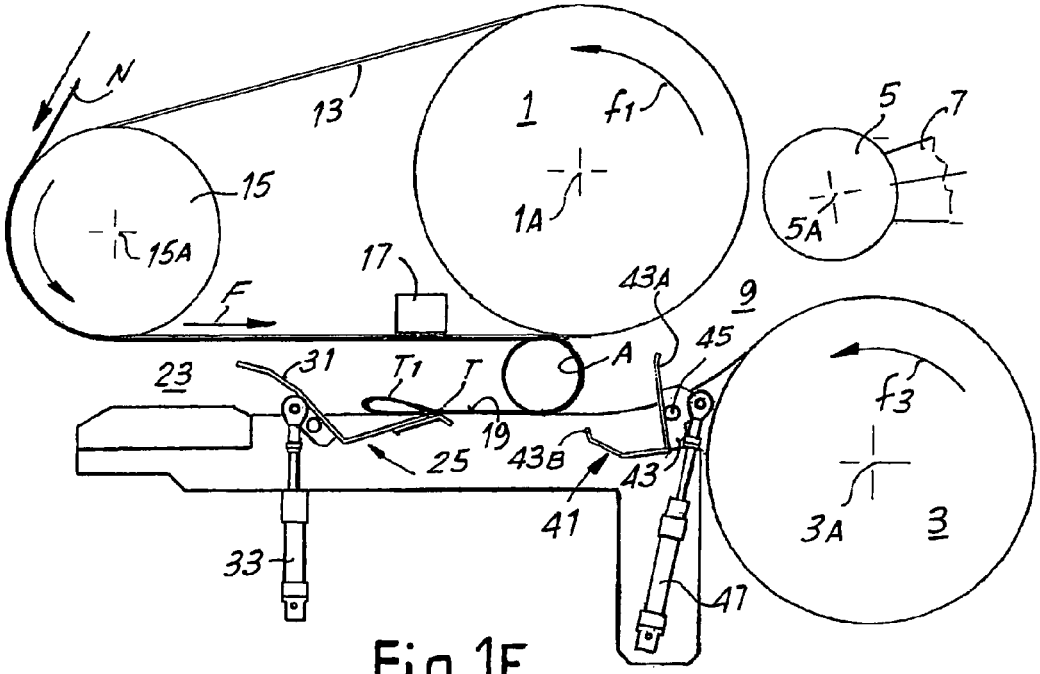

FIG. 1E shows a subsequent step in which the winding core A is even further forward with respect to the position in FIG. 1D and is wrapped through 180° by the web material N that continues to be fed along the guide member 13 and continues to form an increasingly long length of web material T1 adjacent and subsequent to the initial edge T, said length T1 resting on the rolling surface 19 or being slightly raised by return to the idle position of the pressers 27 of the separator device 25 under the pull of the return member 33.

Figure 1F:
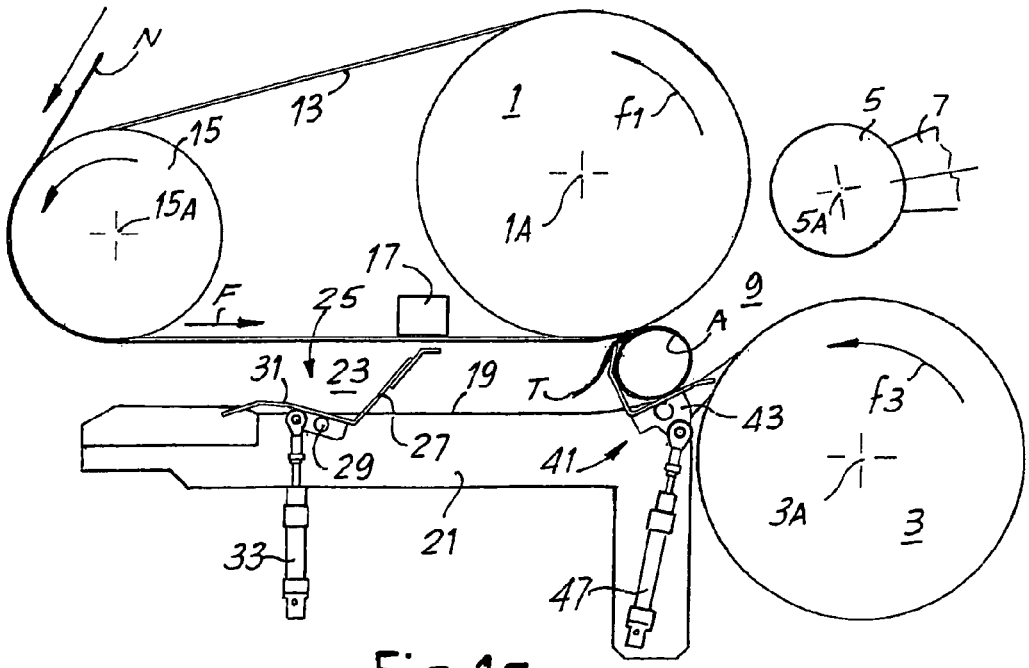

In the subsequent FIG. 1F the core A is moved even further forward to encounter the projections 43A of the movable mechanical member 41 which, as a result of the thrust of the core that rolls on the surface 19, are withdrawn under the rolling surface 19, consequently causing, against the effect of the counteracting member 47, raising of the curved arms 43B which, due to their shape, embrace from behind the core A that is rolling and raise thereagainst the edge T1 of web material that is positioned upstream of the pressure point between the core A and the rolling surface 19. This oscillatory movement of the arms 43B causes closing, or completion of the first turn of web material around the new winding core A.

In substance, the distal ends of the arms 43B are shaped and dimensioned so as to push the edge T1 of web material N in the area in which the web material is in contact with the winding roller 1 and tangent to the winding core A. Continuation of rolling of the core along the surface 19 and then in contact with the winding roller 3 completes insertion of the core through the nip 9 and takes this core into the winding cradle 1, 3, 5 where the new log continues to be formed and to increase in a manner known per se around the new winding core A.

From the description above it is understood how the use of the members 25 and 41 radically simplify the structure of the machine with respect to prior art rewinding machines both as regards severing of the web material and as regards the start of winding the initial free end on each new core A. Severing and forming of the first turn of web material around the new core both take place as a result of interaction between the winding core and mechanical devices which can be devoid of actuators making it unnecessary to power the respective motors and also to synchronize them with the other machine members, in particular the core inserter. It would also be possible to replace both or only one of the return members 33 and 47 with an actuator, such as a movement and control member in synchronism with the movement of the core. Nonetheless, the embodiment described above is more advantageous due to elimination of these actuator mechanisms.

The representation in FIGS. 1A-1F shows all the possible advantages obtainable by the invention. In fact, the movable mechanical member 41 avoids the need for any further measures to fasten the web material, or more specifically the initial portion thereof adjacent to the initial free edge T, to the new winding core at each machine cycle. The core can remain without glue and does not require to be electrostatically charged. Compressed air nozzles to facilitate or complete winding of the first turn of web material around the new winding core are not required either, thereby reducing consumption, noise, increasing the reliability and reducing the cost of the machine.

It must be understood that the separator device 25 can also be used in the absence of the mechanical member 41 and combined with other and different systems to start winding the web material N on the new core. For example, the separator device 25, preferably of passive type, i.e. represented by a mechanical element oscillating as a result of the thrust of the new core inserted in the insertion path, can be combined with a system to glue the cores, or to glue the free edge. Otherwise, an electrostatic, suction or blowing system can be used to start winding the first turn, although the mechanical device 41 is more advantageous for the reasons set forth previously.

Conversely, the mechanical member 41 can also be used in combination with systems for severing or separating the material of a different type with respect to the one shown in FIGS. 1A-1F.

FIGS. 2A to 2F show a different embodiment of the rewinding machine according to the invention. The same numbers indicate parts that are the same or equivalent to those of the previous embodiment shown in FIGS. 1A to 1F.

In the example of embodiment shown in FIGS. 2A to 2F, the assembly of belts forming the guide member 13 and consequently also the return roller 15, are missing. The channel 23 is formed in this case between the rolling surface 19, again formed by a series of adjacent sections 21 extending in the direction of longitudinal extension of the channel 23, and the external cylindrical surface of the winding roller 1. In this case this forms the movable guide member of the web material N.

The separator device 25 and the movable mechanical member 41 for forming or completing the first turn of web material around the new winding core A are produced and operate as described with reference to FIGS. 1A-1F. The operating sequence can be easily understood on the basis of the above description with reference to FIGS. 1A-1F and observing the sequence 2A-2F, without the need for further detailed descriptions.

FIGS. 5A to 5E show an operating sequence of a further embodiment of the rewinding machine according to the invention. The same numbers indicate the same or equivalent parts to those in the previous embodiments. The structure of the winding unit is analogous to the one in FIGS. 2A-2F. There are again provided three winding rollers 1, 3 and 5 with the web material N which is wound and fed around the winding roller 1, also forming the guide member of the web material. The outer cylindrical surface of the roller 1 forms, with the rolling surface 19, the channel 23 for insertion of the winding cores A. The mechanical member 41 for winding the first turn of web material N around the new winding core A is configured substantially analogously to the description with reference to FIG. 1A and shown in detail in FIG. 3. The mechanical member has gaps to allow passage of the pressers 27. However, it must be understood that the relative distance between the members 41 and 25 can be greater than that shown in the drawing, by moving to the left (in the figures) the axis of rotation of the separator device 25 and extending the channel 23 towards the insertion area of the cores. In this way the elements 25 and 41 do not collide and the member 41 can have a form analogous to the one shown for the element 25 in FIG. 4.

The embodiment in FIGS. 5A-5E differs with respect to the embodiment in FIGS. 2A-2F for the different conformation of the separator device, again indicated with 25. In this case the separator device 25 is designed as described, for example, in U.S. Pat. No. 5,979,818. It comprises a plurality of pressers again indicated with 27, rotating around an axis approximately parallel to the axes 1A and 3A, and which penetrate the channel 23 through the spaces left free between the sections 21 to pinch the web material N against the winding roller 1. The peripheral speed of the pressers 27 in the moment in which they act in combination with the winding roller 1 is such as to cause severing of the web material. For this purpose, the example illustrated shows a situation in which this speed is lower than the feed speed of the web material N, so that severing thereof takes place (FIG. 5B) between the pressers 27 of the separator device 25 and the log L in the completion step. It would also be possible for the pressers 27 to move with a peripheral speed greater than that of the web material, causing in this case breakage of the web material between the pressers and the new core A inserted in the channel 23.

Besides the different method with which separation of the web material takes place, the start of winding the first turn of web material around the new winding core A takes place by means of the movable mechanical member 41 with methods substantially the same as those described with reference to FIGS. 1A-1F. Also in this case, additional means such as jets, suction, electrostatic charges or other known means can be used to control and facilitate wedging of the web material between the core and the rolling surface. The completion step of winding the first turn is shown in particular in FIGS. 5D, 5E. In this step in particular the core A is rolling in the length of surface 19 under which the teeth or projections 43A are withdrawn to cause raising of the arms 43B and therefore wedging of a length of the edge T1 of web material N between the new winding core A that is entering the nip 9 and the cylindrical surfaces of the winding roller 1, i.e. the web material N adhering to said roller.

Figure 6A:
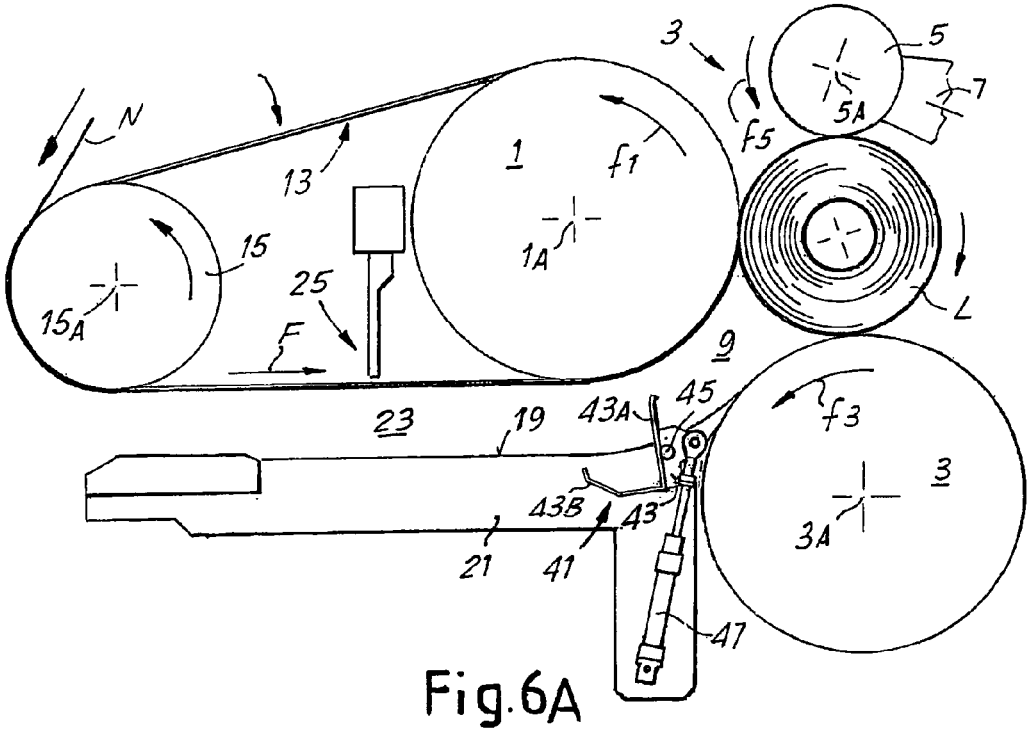
FIGS. 6A to 6F show an operating sequence of a further embodiment of the invention.
Figure 6B:
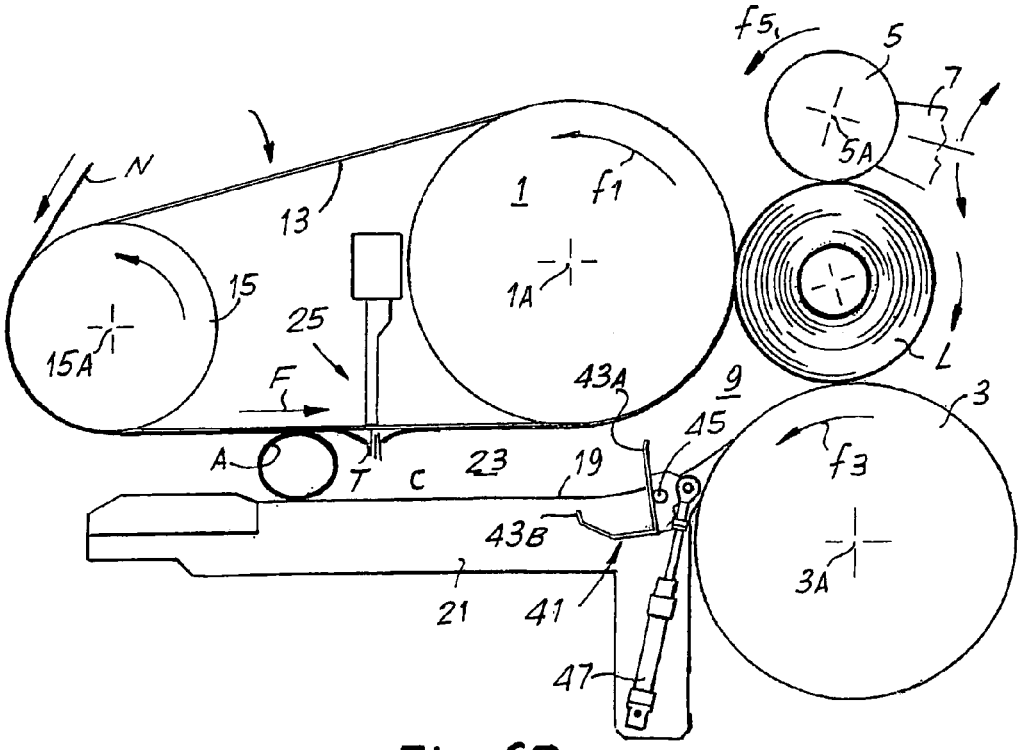

FIGS. 6A to 6F show an embodiment of the invention analogous to the one in FIGS. 1A-1F with regard to operation of the mechanical member for forming the first turn of web material around the new core. The same numbers indicate the same or equivalent parts to those described above with reference to the previous figures. The embodiment in FIGS. 6A-6F differs from the embodiment in FIGS. 1A-1F due to the different design of the separator device 25. In this case the device 25 is constituted by a series of compressed air nozzles disposed in the space delimited between the guide member 13 and the rollers 1, 15 around which the belts forming the guide member 13 are fed. The compressed air nozzles 25 are oriented against the web material N that is fed adhering to, i.e. in contact with, the lower surface of the lower branch of the guide member 13. More specifically, the nozzles forming the separator device 25 face the free space remaining between the parallel belts that form the member 13 so that they can interact with a jet of pressurized air on the web material N, as shown in FIG. 6B.

Operation of the rewinding machine is shown clearly in the sequence in FIGS. 6A-6F. In FIG. 6B the winding core A is inside the channel 23 and rolls on the fixed surface 19. The separator device 25 is activated by generating jets of compressed air that cause tearing of the web material preferably along a perforation line which is at this instant substantially level with the nozzles of the separator device 25. The jets of air also push the initial edge T downwards so as to facilitate winding around the winding core A which continues to be fed by rolling.

Figure 6C:
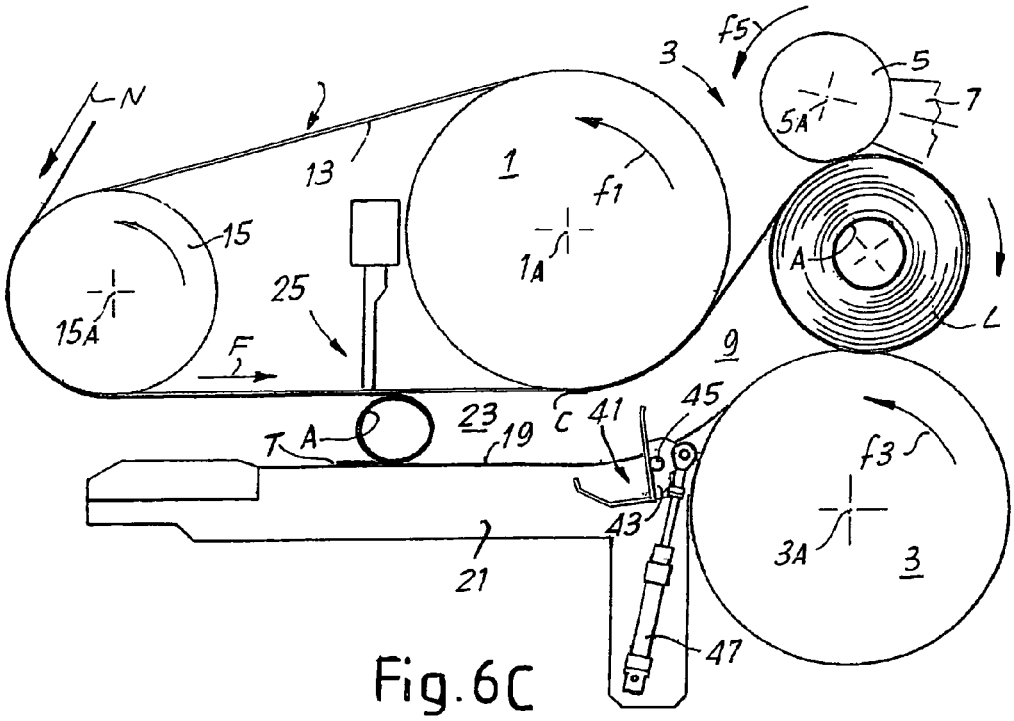
Figure 6D:
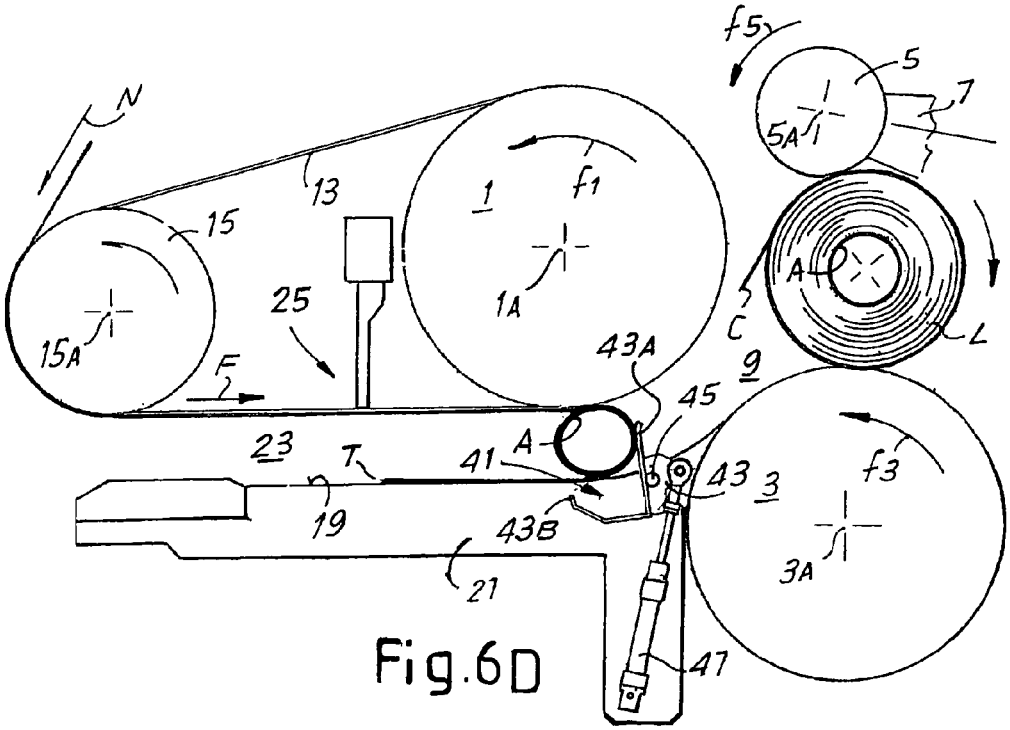
Figure 6E:
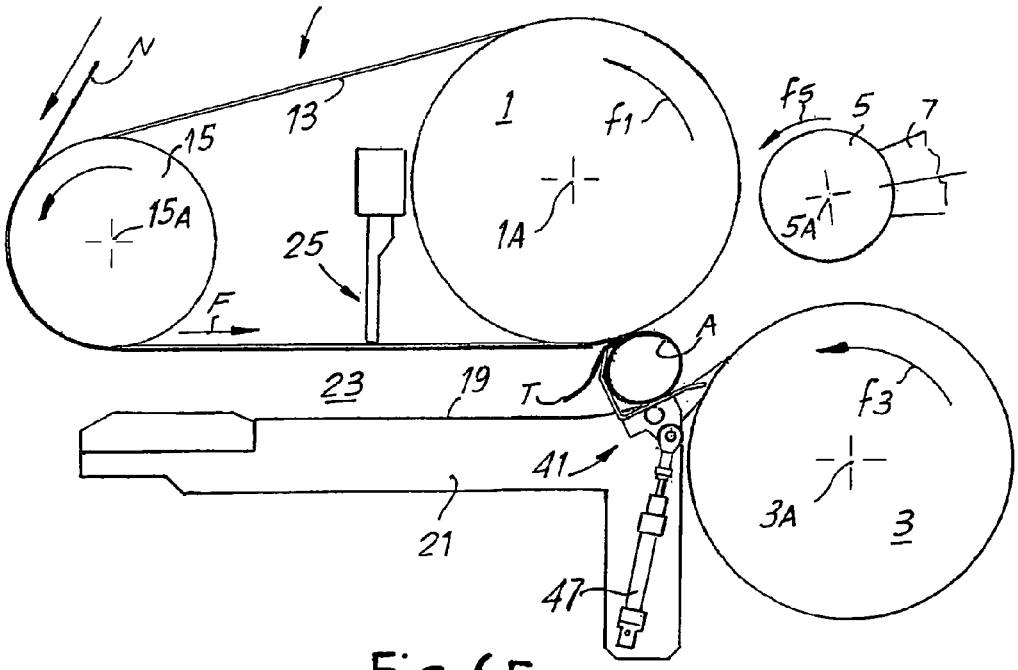

In FIG. 6C the winding core has passed the position of the separator device 25 and therearound a loop of approximately 180° of web material has been formed in contact with said core. The web material fed along the guide member 13 gradually passes under the winding core A as already shown for the embodiment in FIGS. 1A-1F until the core encounters the mechanical member 41 and, pushing against the projections 43A, causes lifting through rotation in a clockwise direction (in the figure) of the arms 43B against the effect of the counteracting member 45 so as to wedge the initial edge T1 of the web material N in the area delimited between the surface of the winding core A and the surface of the winding roller 1.

Figure 6F:
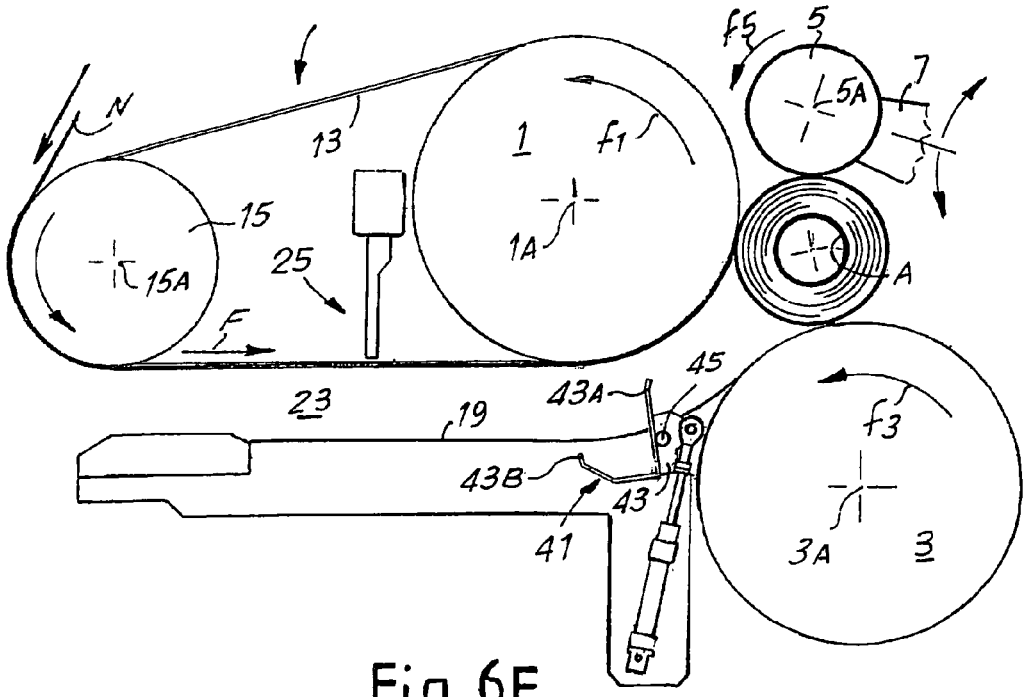

In FIG. 6F the new winding core is already in the winding cradle 1, 3, 5 and the first portion of the log L has formed thereon while the mechanical member 41 has returned to the idle position thereof as a result of the return member 47.

Further developments of the invention are shown in FIGS. 7A-10. With initial reference to FIGS. 7A-7E and 8, in this further embodiment the rewinding machine comprises a winding unit with three winding rollers 1, 3 and 5, the last being carried by an oscillating arm 7 or by another mechanism that allows it to move away from the rollers 1, 3. Reference number 9 indicates the nip formed between the winding rollers 1 and 3 and reference number 19 indicates a rolling surface, for example formed of a plurality of side-by-side sections 21 defining a comb-like structure.

The surface 19 forms, together with the cylindrical surface of the winding roller 1, a channel 23 for insertion of the winding cores A. Around the winding roller 1 there is fed a web material N, which is wound in logs L as a result of the rotation imparted to the core and to the log being formed by the winding rollers 1, 3 and 5 which rotate according to the arrows f1, f3 and f5.

Reference number 25 indicates a severing member or separator device of the web material, comprising pressers 27 and designed as described for example in U.S. Pat. No. 5,979,818. Operation of the severing member or separator device 25 is described in detail in the aforesaid U.S. Pat. No. 5,979,818

Along the channel 23, in a position directly upstream of the nip 9 there is disposed a mechanical member indicated as a whole with 41, having the function of forming the first turn of web material around the new winding core after severing of the web material N upon completion of winding each single log L.

With reference also to FIG. 8, the mechanical member 41 comprises a plurality of brackets 43 hinged about an axis 45 substantially parallel to the axes 1A, 3A and 5A of the rollers 1, 3 and 5. Oscillating about the axis 45 the brackets 43 pass between the sections 21 which form a comb-like structure through which the separator device 27 can also penetrate.

In one embodiment, each bracket 43 has a projection 43A which, in non-operating or idle conditions, projects as shown in FIGS. 7A to 7D inside the channel 23 for insertion of the cores A. Besides the projections 43A, the brackets 43 are provided with curved arms 43B that carry, at a distal end thereof, a nozzle 43C. In practice, each bracket can carry a nozzle 43C or the nozzles 43C can be produced in a single transverse duct, for example a plastic tube, a metal pipe or the like, fixed in several points to the brackets 43 and more precisely to the curved arms 43B thereof. The sections 21 can have slots along the rolling surface 19 of a length (in the direction of feed of the cores A) that does not obstruct rolling of the cores, although with dimensions sufficient to house the pipe or duct forming the nozzles 43C, so that they do not project in the channel 23 by an extent that obstructs or interferes with passage of the winding core. Advantageously, in alignment with and acting in the opposite direction to the nozzles 43C, the curved arms 43B carry nozzles 43D. In a practical embodiment a plastic tube is fastened to the end of the curved arms 43B. The tube is perforated according to two alignments approximately opposite each other, a first alignment of holes oriented according to the approximately the same direction as the end part of the curved arms 43B, a second alignment rotated through approximately 180° with respect to the first alignment (see in particular the enlargement in FIG. 8A). In this way the jets of air exiting from the holes of the second alignment balance the thrust of the jets of air exiting from the holes of the first alignment, making operation of the mechanical member 41 regular and without anomalous reactions.

In any case, irrespective of how they are produced, the nozzles 43C form a movable blowing member carried by the brackets 43 and therefore ultimately by the mechanical member 41. The flows of compressed air exiting from the nozzles 43C together with the action of the mechanical member 43B carrying them, assist in, facilitate or contribute towards forming the first turn of web material around the winding core A in the initial forming step of a new log L, in the manner that will be described in greater detail with reference to the sequence in FIGS. 7A to 7E.

In an embodiment of the invention, the winding roller 1 has a cylindrical wall 1B (see FIGS. 7A and 7B) with perforations 1C to define a cylindrical shell through which there can be generated a flow of air oriented from the inside towards the outside of the cylindrical surface. As shown schematically in FIG. 7B and as will be described in greater detail with reference to FIGS. 9 and 10, inside the winding roller 1 a blowing device is arranged, indicated schematically with 52. This blowing device can be positioned in a fixed arrangement in the position in FIG. 7B, or can be mounted rotating inside the winding roller 1 for the purposes that will be explained hereunder and by means of a structure described with reference to FIG. 10. Instead of inside the winding roller 1, the blowing device can be designed with a plurality of curved blowing ducts, housed at least partly inside annular channels provided in the winding roller 1, although this solution is less advantageous due to the marks that these annular channels can leave on the web material N wound on the log L.

Figure 7A:
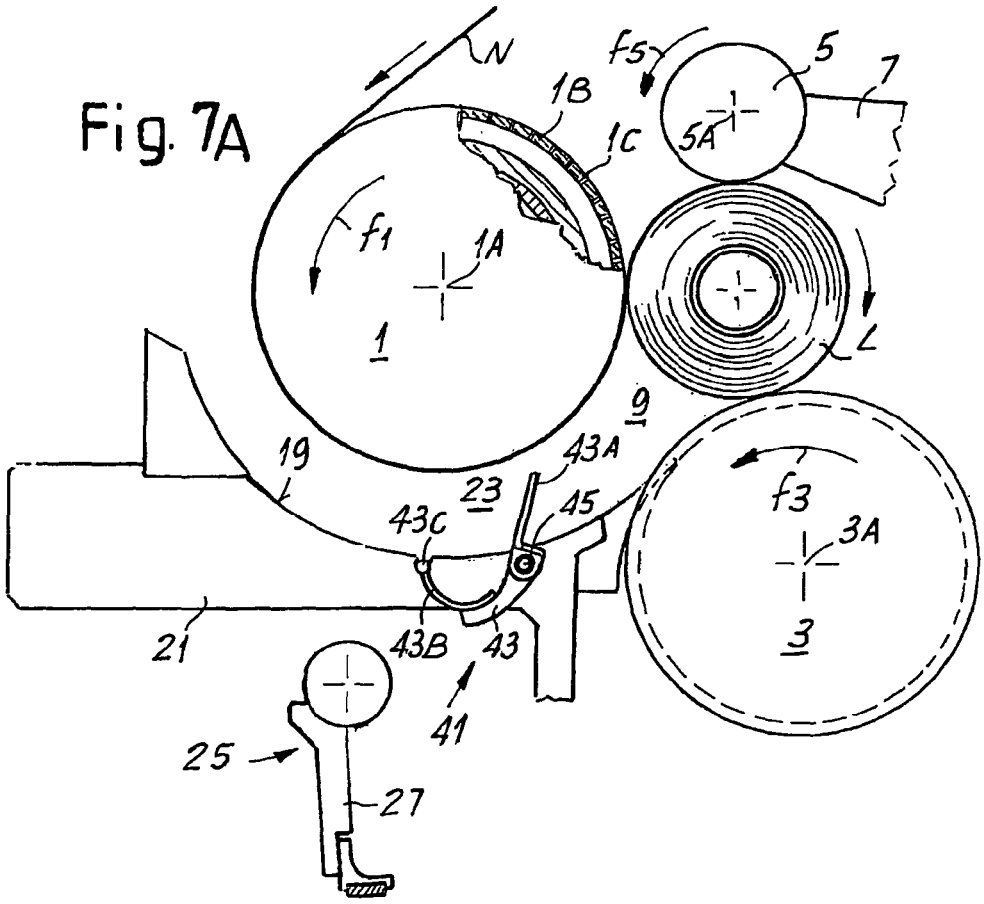

Operation of the rewinding machine shown in FIGS. 7A-8 is briefly the following, greater details being set forth in the description of previous embodiments of FIGS. 1-6.

Figure 7B:
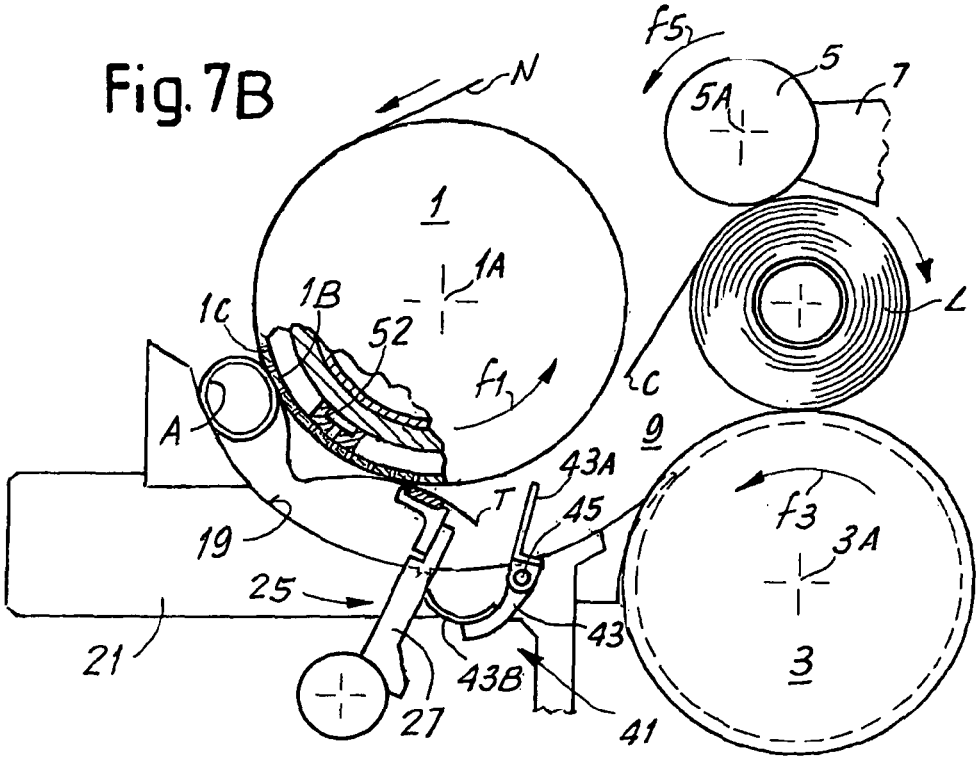

FIG. 7A shows the conclusive step of the winding cycle of a log L located in the winding cradle formed by the winding rollers 1, 3 and 5. In FIG. 7B insertion of a new winding core A into the channel 23 starts. Insertion of the core takes place in a manner known per se and is not described in greater detail herein. The separator device 25 has rotated through approximately 190-200° with respect to the position in FIG. 7A and has caused breakage, cutting or severing of the web material to form a final free edge C that will finish winding on the log L and an initial edge T that will be wound on the new winding core A.

In an embodiment of the invention the separator device 25 rotates at a speed whereby when it presses against the winding roller 1 the peripheral speed thereof is lower than that of the web material N and than the peripheral speed of the winding roller 1. This difference in speed causes the web material to break or tear along the perforation line and form the edges T and C in an intermediate position between the core A and the log L.

A jet of air generated by the blowing device 52 in the position shown in FIG. 7B facilitates detaching of the portion of web material N adjacent to the initial free edge, said detaching being facilitated by the fact that this portion of web material has been decelerated by the separator device 25.

Figure 7C:
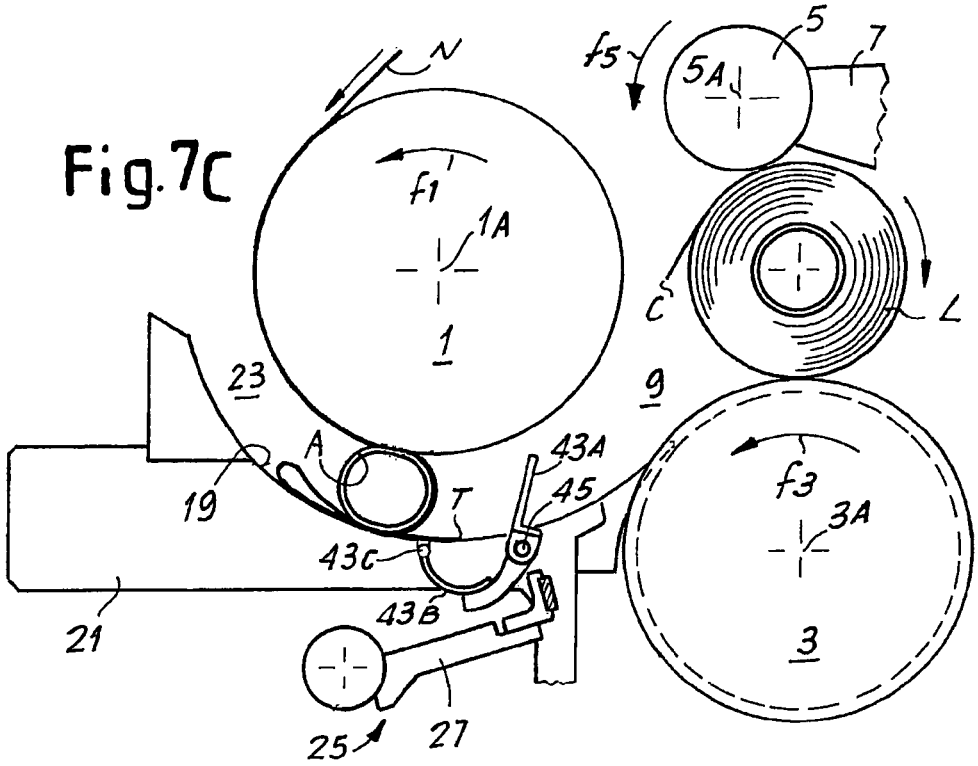

FIG. 7C shows a subsequent step, wherein the separator device 25 is withdrawn under the rolling surface 19 and the core A continues to roll on the rolling surface 19. Rolling is obtained due to the fact that the core A is in contact on the one side with a fixed surface 19 and on the other with a rotating cylindrical surface of the winding roller 1. Initially the core A rolls in direct contact with the surface 19 and subsequently in contact with the initial portion of web material N directly downstream of the initial edge T, as this portion of web material is lying on the surface 19 and the core rolls thereover.

Figure 7D:
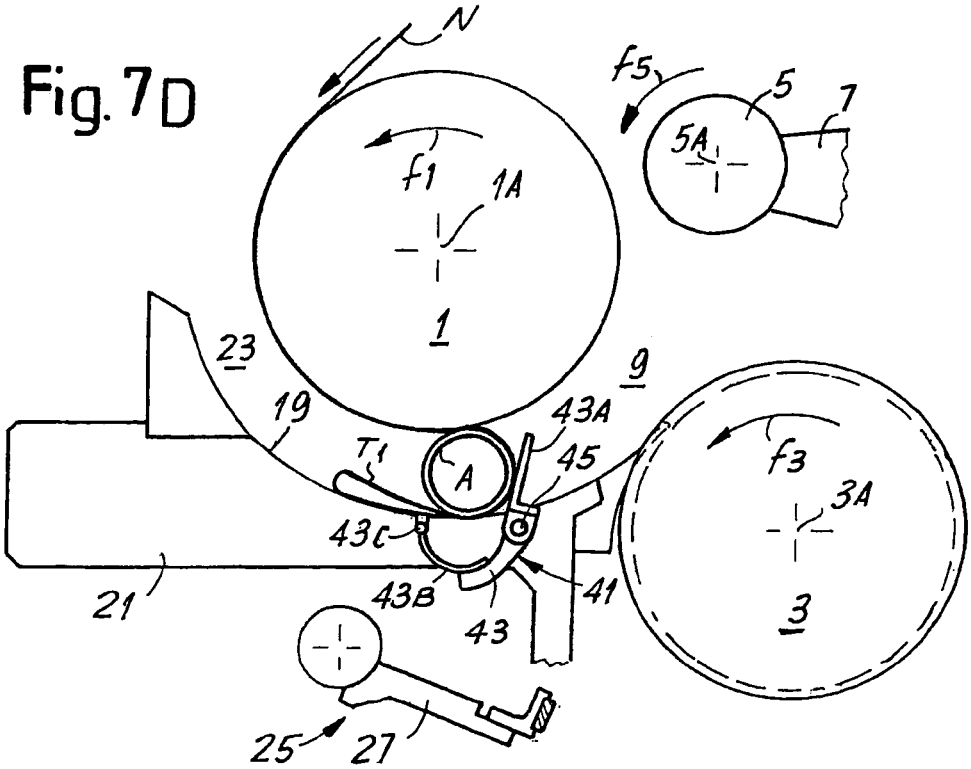

In FIG. 7D the winding core A starts contact with the projections 43A of the mechanical member 41. Due to the rolling movement of the core A along the channel 23, it pushes on the projections 43A causing oscillation of the mechanical member 41 with the brackets 43 about the axis of oscillation 45, so that the curved arms 43B start to lift, thus penetrating the channel 23 passing through the comb-like structure formed by the sections 21.

FIG. 7E shows a subsequent step, in which the curved arms 43B are in their maximum raised position. The distal ends of the arms carry the nozzles 43C in proximity to the wedge-shaped area or volume defined between the external surface of the winding core A and the cylindrical surface of the winding roller 1. The jets of air generated by the nozzles 43C act on the portion T1 of web material behind the core A. These jets gradually move upward as a result of oscillation in a clockwise direction (in the figure) of the arms 43B with consequent gradual lifting and wedging of the portion T1 of web material between the surface of the roller 1 (or more precisely the portion of web material N adhering thereto) and the surface of the winding core A. The thrust generated by the jets of air delivered by the nozzles 43C which move as a result of the movement of the mechanical member 41 complete forming of the first turn of web material around a new core without the need to use glue. In this way it is not necessary for the ends of the curved arms 43B to be particularly thin in order to draw very close to the opposite surfaces of the roller 1 and of the new core A.

Once the first turn has been formed, the core A continues to roll through the nip 9 defined between the winding rollers 1 and 3 and is inserted in the winding cradle also in contact with the winding roller 5 to complete the winding cycle until reaching the arrangement in FIG. 7A.

Figure 9:
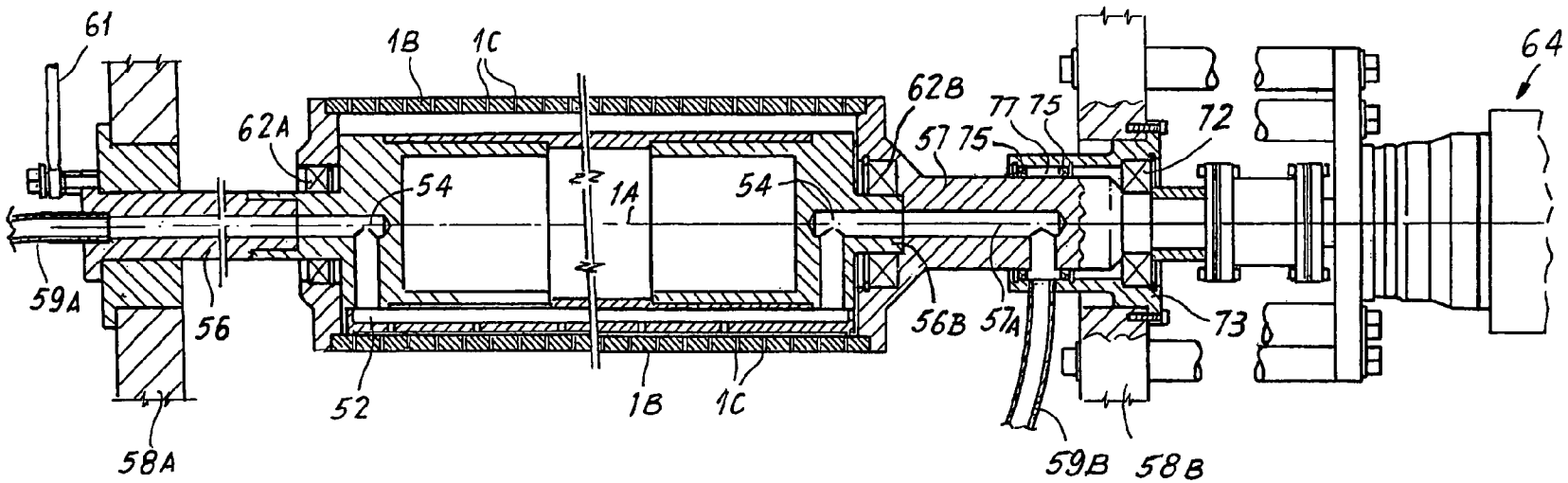
FIG. 9 shows a longitudinal section of a winding roller with a fixed blowing device therewithin.

FIG. 9 shows a longitudinal section of the winding roller 1 and of the cylindrical wall 1B thereof provided with perforations 1C. Inside the roller 1 a chamber 52 is provided, which is fixed in the position in FIG. 7B or adjustable around said position. The chamber 52 is connected by means of end ducts 54, exiting through supporting shanks 56A, 56B, to compressed air feed pipes 59. The winding roller 1 is supported by means of a first bearing 62A on the shank 56A, which is in turn supported by a fixed side panel 58A. On the opposite side the roller 1 is supported by a second support 62B fitted on the shank 56B. The support 62B is housed in a seat provided in an end flange of the roller 1, integral with which is a shank 57 with an axial hole 57A, to form an extension of the end duct 54 of the shank 56B. The shaft or shank 57 is supported by means of a bearing 72 in a second fixed side panel 58B. The bearing 72 is housed inside a flanged sleeve 73 which, by means of seals 75, defines an annular fixed chamber 77 around a portion of the shaft or shank 57, at the level of a radial hole 57B in communication with the axial hole 57A and with the compressed air duct 59B. The arrangement is such that by means of the duct 59B compressed air is fed into the chamber 52 passing through the rotating shaft or shank 57 that makes the roller 1 rotate. Reference number 64 schematically indicates the actuating motor, aligned with the roller 1.

A tie rod 61 allows angular adjustment of the position of the chamber 52.

Figure 10:
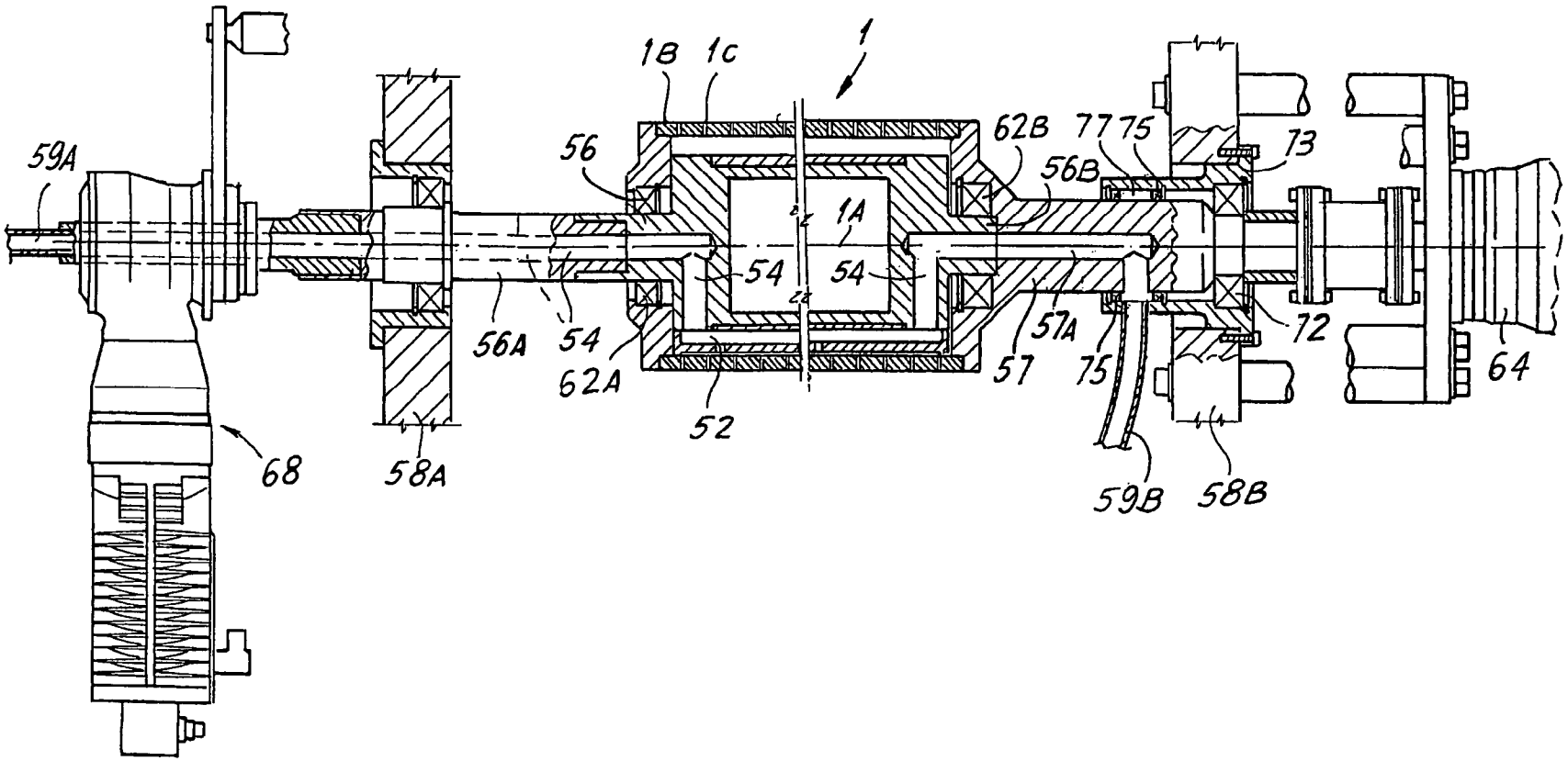
FIG. 10 shows a section similar to the section in FIG. 9 of a winding roller with a rotating blowing device therewithin.

FIG. 10 shows a configuration wherein the blowing device 52 housed inside the winding roller 1 is rotating to follow, by means of an angular movement, the feed of the web material N about the axis 1A of the winding roller 1. The same numbers indicate the same or equivalent parts to those in FIG. 9. In this embodiment the shank 56A is torsionally coupled with the output shaft of an electronically controlled gear motor 68 and again has an axial hole connected to a tube or duct for compressed air feed.

With this configuration the internal portion of the roller 1, in which the blowing device 52 is provided, can be made to rotate about the axis 1A of the winding roller 1 with a motion imparted by the gear motor 68 according to a time sequence which is controlled separately with respect to rotation, substantially at constant speed, of the winding roller 1 imparted by the motor 64. More specifically, the device 52 can be made to rotate at the same speed as the speed at which the loop of web material N shown in FIG. 7B is formed, following the movement of this portion of web material to a suitable angular position, for example with an angular feed of approximately 30° with respect to the position shown in FIG. 7B.

The use of the blowing systems described facilitates detaching of the web material from the winding roller 1 (by means of the device 52) or (by means of the nozzles 43C) facilitates insertion or wedging of the portion T1 of web material adjacent to the initial edge T in the space between the winding roller 1 and the winding core A, on the back of said core with respect to the direction of feed. Both these measures result in an increase in machine efficiency. Although they are described in this embodiment in combination with each other, it would also be possible for only the blowing device 52 or only the nozzle system 43C to be adopted on a machine.

It is understood that the drawing only shows an example given by way of a practical demonstration of the invention, as said invention can vary in forms and arrangements without however departing from the scope of the concept underlying the invention. Any reference numbers in the appended claims are provided to facilitate reading of the claims with reference to the description and to the drawing, and do not limit the scope of protection represented by the claims.

The invention claimed is:

1. A method for winding a web material around a winding core, comprising forming a first turn of web material around said winding core, wherein an initial portion of the web material is folded by a separator device, and a mechanical member moves behind said winding core with respect to a core advancing direction thus moving said initial portion of said web material between the winding core and a subsequent portion of the web material located upstream of said winding core with respect to a direction of feed of the web material.

2. A method for winding a web material around a winding core, comprising:

advancing a web material along an advancement path toward a winding cradle;

winding a first log of said web material around a first core;

upon completion of winding the first log, severing the web material by a web separator device forming a final edge and an initial edge, and wedging said initial edge of the web material against a new winding core;

starting to wind a second log of said web material around said new winding core by forming a first turn of web material around said new winding core;

wherein said first turn of web material around said new winding core is formed with aid of a movable mechanical member arranged downstream of said web separator device along said advancement path.

3. The method as claimed in claim 2, further comprising carrying the new winding core into contact with the web material along said feed path;

upon completion of winding said first log, severing the web material downstream of a point of contact with the new winding core forming said initial edge.

4. The method as claimed in claim 3, wherein said winding core is fed rolling in contact with the web material, speed of the winding core in the point of contact being approximately same as speed of the web material;

feed movement of the winding core causing partial winding of an initial portion of the web material around said core;

said mechanical member completes forming of said first turn of the web material around said core.

5. The method as claimed in claim 4, wherein said mechanical member moves the initial portion of the web material between an external surface of the winding core and the web material upstream of the point of contact between the web material and the new winding core.

6. The method as claimed in claim 2, wherein said winding core is fed rolling along a rolling surface, in contact with the web material, along a channel defined between said rolling surface and a movable guide member, the web material being guided along said guide member and in contact therewith;

the web material is severed downstream of the point of contact with said winding core located in the channel forming said initial edge; and said mechanical member is inserted in said channel upstream of said winding core after the winding core has been fed along said channel rolling on the initial edge which is disposed between the winding core and said rolling surface, the mechanical member moving a portion of the web material located behind the winding core with respect to a direction of feed thereof along the channel towards the movable guide member wrapping the portion of the web material around said core.

7. The method as claimed in claim 6, wherein said mechanical member moves the portion of the web material between the winding core and the web material behind the winding core and in contact with the movable guide member.

8. The method as claimed in claim 6, wherein said mechanical member is hinged about a first axis external to said channel and substantially parallel to a second axis of the winding core in said channel, and rotates or oscillates about said first axis synchronously with passage of said winding core along the channel.

9. The method as claimed in claim 8, wherein said winding core controls oscillation of said mechanical member interfering with a portion thereof projecting in the channel.

10. The method as claimed in claim 2, wherein said mechanical member is controlled by a control actuator synchronously with movement of said winding core.

11. The method as claimed in claim 2, wherein said mechanical member is controlled by said winding core.

12. The method as claimed in claim 11, wherein said winding core is fed along an insertion path that interferes with said mechanical member, passage of the winding core causing oscillation of the mechanical member and insertion of the mechanical member in said insertion path behind the winding core.

13. The method as claimed in claim 2, further comprising providing a rolling surface for the winding core;

providing a movable guide member, said rolling surface and said movable guide member forming a winding core insertion channel;

feeding the web material along said advancement path in contact with said guide member;

inserting said new winding core in said channel in contact with said rolling surface and with said web material;

feeding said new winding core by rolling along said channel;

severing the web material downstream of said new winding core forming the initial edge and the final edge;

rolling said new winding core on the initial edge and on a portion of the web material adjacent thereto positioned between said new winding core and said rolling surface;

wrapping said portion of the web material adjacent to the initial edge around said core by said movable mechanical member.

14. The method as claimed in claim 13, wherein said movable mechanical member inserts the portion of the web material between the winding core and the web material in contact with said movable guide member.

15. The method according to claim 2, wherein at least one first gaseous flow generated by blowing members carried by said movable mechanical member is used in winding of said first turn around said winding core.

16. The method as claimed in claim 15, further comprising starting to wind said second log of web material around said new winding core by said mechanical member and said blowing members carried by said mechanical member.

17. The method as claimed in claim 15, wherein at least one second gaseous flow is generated which is opposed to said at least one first gaseous flow used in said winding of said first turn around said winding core.

18. The method according to claim 2, wherein the web material is fed around a winding roller and wherein a gaseous flow is generated and used in detaching of the web material from said winding roller upon completion of winding a log of web material.

19. A rewinding machine to produce logs of web material wound around winding cores, comprising:

a winding unit;

a feed path of a web material;

a separator device to sever the web material upon completion of winding each log and folding back an initial edge of the web material;

an insertion path for insertion of winding cores towards said winding unit;

a movable mechanical member to facilitate forming of a first turn of the web material around each winding core inserted in said insertion path, wherein said movable mechanical member is arranged along said feed path downstream of said separator device.

20. The machine as claimed in claim 19, wherein said movable mechanical member is controlled by a respective winding core fed along the insertion path.

21. The machine as claimed in claim 20, wherein said movable mechanical member is supported around an axis of oscillation, oscillating movement being controlled by passage of the winding cores which act on a projecting portion of said movable mechanical member.

22. The machine as claimed in claim 19, further comprising a control actuator to actuate said mechanical member synchronously with passage of the respective winding core.

23. The machine as claimed in claim 19, wherein said mechanical member is structured to provide an oscillating movement.

24. The machine as claimed in claim 19, wherein said mechanical member comprises a projection extending in said insertion path of the winding cores constructed and arranged to interact with the winding cores fed along said insertion path, interaction between said projection and said winding cores causing actuation of said mechanical member.

25. The machine as claimed in claim 19, wherein said mechanical member comprises at least one folding arm structured to fold the web material towards and against a respective winding core to facilitate forming of the first turn of the web material around said respective winding core, said at least one folding arm drawing close to said respective winding core from behind with respect to a direction of feed of the respective winding core along the insertion path.

26. The machine as claimed in claim 19, wherein said separator device is arranged along the feed path of the web material to act on the web material in an intermediate position between a log reaching completion and a new winding core inserted in said insertion path.

27. The machine as claimed in claim 26, wherein said separator device is constructed and arranged to act on the web material in a position along said feed path upstream of the movable mechanical member.

28. The machine as claimed in claim 19, comprising:

a rolling surface for the winding cores;

a movable guide member, said feed path of the web material extending at least partly in contact with said movable guide member, and said movable guide member defining with said rolling surface a channel for insertion of the winding cores, wherein the winding cores are carried into contact with said rolling surface and with the web material; and wherein said movable mechanical member is constructed and arranged to be inserted in said channel behind a respective winding core with respect to a direction of feed of the respective winding core in said channel.

29. The machine as claimed in claim 28, wherein said separator device is constructed and arranged to act on the web material in an intermediate position along said channel.

30. The machine as claimed in claim 28, wherein said rolling surface is formed at least partly of a plurality of sections arranged side-by-side and spaced from one another extending along said channel, and wherein said movable mechanical member comprises a plurality of folding arms disposed and arranged to be inserted in said channel passing between said sections.

31. The machine as claimed in claim 30, wherein said movable mechanical member comprises a plurality of projections projecting in said channel between said sections, passage of said respective winding core along said channel pushing said projections between said sections and causing oscillation of said movable mechanical member.

32. The machine as claimed in claim 28, wherein said guide member is a winding roller around which said web material is fed and forming part of a peripheral winding cradle.

33. The machine as claimed in claim 19, wherein said mechanical member is curved and has a concavity facing said winding cores inserted in said insertion path when said mechanical member acts on said web material.

34. The machine as claimed in claim 19, including at least one blowing member carried by said mechanical member to generate a.gaseous flow that facilitates winding of the first turn.

35. The machine as claimed in claim 34, including at least two of said at least one blowing member carried by said mechanical member and oriented to generate a gaseous flow approximately opposed to the gaseous flow generated by said blowing member used to wind the first turn.

36. The machine as claimed in claim 19, including a device that generates a gaseous flow exiting from a cylindrical surface of a winding roller to facilitate detaching of an initial free edge of the web material from the winding roller upon completion of winding a log of the web material.

37. The machine as claimed in claim 36, wherein said device comprises a chamber fixed inside the winding roller, said winding roller having an at least partly perforated cylindrical surface.

38. The machine as claimed in claim 36, wherein said device comprises a blowing member rotating inside the winding roller, said winding roller having an at least partly perforated cylindrical surface and said blowing member rotating in a direction common with a direction of rotation of the winding roller.

39. The machine as claimed in claim 19, wherein said movable mechanical member is arranged to approach said winding core from behind with respect to a direction of feed of the winding core along said insertion path.

40. A method for winding logs of web material around winding cores comprising winding a first log of web material around a first core;

inserting a second winding core in an insertion path;

severing the web material downstream of said second winding core forming a final edge which is wound on the first log and an initial edge to be wound on the second winding core, wherein said initial edge of the web material is wedged against said second winding core following said severing;

feeding said second winding core in a direction of feed along said insertion path beyond the initial edge;

completing a first turn of the web material around said second winding core by moving a portion of the web material located behind said second winding core with respect to the direction of feed of the winding core towards said second winding core by a mechanical member which is downstream in the direction of feed to said severing.

41. The method as claimed in claim 40, wherein said second winding core acts in combination with said mechanical member to cause a movement thereof which moves said web material towards said second winding core.

42. A method for winding a web material around a winding core, comprising: advancing said web material;

winding a log of said web material around a first core;

advancing a second core in an advancement direction;

severing said web material between said log and said second core, thus forming a final edge of said web material to be wound around said log and an initial edge of said web material to be wedged against said second core; rolling said second core on said initial edge such that said second core moves past said initial edge becoming partly wrapped by said web material; folding said initial edge behind and around said second core by a mechanical member to form a first turn of said web material around said second core.

43. The method as claimed in claim 42, further comprising: arranging a web severing device upstream of said mechanical member with respect to said direction of advancement; severing said web material with said web severing device when said second core is upstream of said web severing device with respect to said direction of advancement; moving said core past said web severing device along said advancement direction; folding said initial edge located beyond said second core between said second core and said web severing device by said mechanical member.

44. The method as claimed in claim 42, further comprising: arranging a web severing device upstream of said mechanical member with respect to said direction of advancement; severing said web material with said web severing device when said second core is upstream of said web severing device with respect to said direction of advancement; moving said second core past said web severing device along said direction of advancement; introducing said mechanical member between said severing device and said second core for supporting formation of said first turn of said web material around said second core.

* * * * *